US011835317B2

(12) United States Patent
Summers

(10) Patent No.: US 11,835,317 B2
(45) Date of Patent: Dec. 5, 2023

(54) BOW ACCESSORY COUPLER AND METHOD

(71) Applicant: Daniel A. Summers, Alpine, WY (US)

(72) Inventor: Daniel A. Summers, Alpine, WY (US)

(73) Assignee: QTM, LLC, Madison Heights, VA (US)

( * ) Notice: Subject to any disclaimer, the term of this patent is extended or adjusted under 35 U.S.C. 154(b) by 0 days.

(21) Appl. No.: 17/750,556

(22) Filed: May 23, 2022

(65) Prior Publication Data

US 2022/0282949 A1 Sep. 8, 2022

Related U.S. Application Data

(63) Continuation of application No. 16/926,182, filed on Jul. 10, 2020, now Pat. No. 11,359,883, which is a continuation of application No. 16/838,516, filed on Apr. 2, 2020, now Pat. No. 11,098,974, which is a continuation of application No. 16/410,483, filed on May 13, 2019, now Pat. No. 10,690,437, which is a continuation of application No. 16/012,364, filed on Jun. 19, 2018, now Pat. No. 10,295,296, which is a continuation of application No. 15/809,349, filed on Nov. 10, 2017, now Pat. No. 10,077,964, which is a continuation of application No. 15/247,456, filed on Aug. 25, 2016, now Pat. No. 9,829,270.

(60) Provisional application No. 62/209,519, filed on Aug. 25, 2015.

(51) Int. Cl.

| | |
|---|---|
| ***F41B 5/14*** | (2006.01) |
| ***F41G 1/467*** | (2006.01) |
| ***F41B 5/20*** | (2006.01) |

(52) U.S. Cl.
CPC ..... *F41B 5/1403* (2013.01); *F41B 5/14* (2013.01); *F41B 5/143* (2013.01); *F41G 1/467* (2013.01)

(58) Field of Classification Search
CPC ..... F41B 5/14; F41B 5/143; F41G 1/467
See application file for complete search history.

(56) References Cited

U.S. PATENT DOCUMENTS

| | | | |
|---|---|---|---|
| 3,163,938 | A | 1/1965 | Reynolds |
| 3,410,644 | A | 11/1968 | McLendon |
| 3,574,944 | A | 4/1971 | Reynolds |
| 3,769,956 | A | 11/1973 | Simo |
| 3,844,268 | A | 10/1974 | Ikeya |

(Continued)

OTHER PUBLICATIONS

"Hoyt Intensity Bow and Integra Sight Mount;" Dated on or Before Aug. 24, 2015; retrieved from the Internet: https://www.popscreen.com/prod/MTI2MTM4ODY5/Hoyt-USA-Intensity-Compound-Bow-with-Integra-Sight-eBay; 1 page.

(Continued)

*Primary Examiner* — John A Ricci
(74) *Attorney, Agent, or Firm* — Barclay Damon LLP

(57) ABSTRACT

A bow accessory coupler and method are disclosed herein. The bow accessory coupler, in an embodiment, includes a body. The body has a first surface including an interface configured to face in a first direction and engage a rear face of a bow riser. The body also has a second surface configured to face in a second direction. Furthermore, the body includes a portion having a dovetail shape. The body defines at least one opening configured to receive a fastener, and the portion is configured to be coupled to an element of an accessory.

190 Claims, 18 Drawing Sheets

(56) References Cited

U.S. PATENT DOCUMENTS

| | | | | |
|---|---|---|---|---|
| 3,864,836 | A | 2/1975 | Haines | |
| 4,136,461 | A | 1/1979 | Gasser | |
| 4,538,784 | A * | 9/1985 | O'Flanagan | A47B 57/567 248/297.21 |
| 5,289,814 | A | 3/1994 | Maisano | |
| 5,341,791 | A | 8/1994 | Shafer | |
| 5,372,119 | A | 12/1994 | Kidney | |
| 5,379,746 | A | 1/1995 | Sappington | |
| 5,383,441 | A * | 1/1995 | Lightcap, Jr. | F41B 5/143 124/44.5 |
| 5,507,272 | A | 4/1996 | Scantlen | |
| 5,524,601 | A | 6/1996 | Slates et al. | |
| 5,529,049 | A | 6/1996 | Antalosky | |
| 5,853,001 | A | 12/1998 | Vyprachticky | |
| 6,477,778 | B1 * | 11/2002 | Lorocco | F41G 1/345 33/265 |
| 6,557,541 | B2 | 5/2003 | Pinto, Jr. | |
| 6,688,297 | B1 | 2/2004 | Clague | |
| 6,895,676 | B1 | 5/2005 | Mendyk | |
| 7,021,301 | B2 | 4/2006 | Nagle | |
| 7,464,908 | B2 | 12/2008 | Files | |
| 7,775,201 | B2 | 8/2010 | Cooper | |
| 8,065,994 | B2 | 11/2011 | Holmberg | |
| 8,328,147 | B2 | 12/2012 | Gardner et al. | |
| 8,342,161 | B2 | 1/2013 | Harwath et al. | |
| 8,505,527 | B2 | 8/2013 | Kempf | |
| 8,839,772 | B2 | 9/2014 | Lee | |
| 8,939,137 | B2 | 1/2015 | Hunt | |
| 9,004,054 | B2 | 4/2015 | Khoshnood | |
| 9,151,567 | B1 | 10/2015 | Estridge | |
| 9,651,330 | B1 | 5/2017 | LoRocco et al. | |
| 9,829,270 | B2 | 11/2017 | Summers | |
| 10,088,264 | B2 | 10/2018 | Summers et al. | |
| 10,295,296 | B2 | 5/2019 | Summers | |
| 10,539,390 | B2 | 1/2020 | Summers et al. | |
| 2013/0081605 | A1 | 4/2013 | Lee, Jr. | |
| 2013/0233292 | A1 | 9/2013 | Gardner | |
| 2020/0149838 | A1 | 5/2020 | Summers et al. | |

OTHER PUBLICATIONS

Hoyt Bow User Manual; Dated on or Before Aug. 24, 2015; 23 pages.

Trophy Ridge; "Vertical Drop Away Arrow Rest Manual;" Dated on or Before Apr. 11, 2015; 2 pages.

Hunter's Friend; "Bow Sight Selection Guide—Archery Help—Hunter's Friend;" Feb. 12, 2007; retrieved from the Internet ,https://www.huntersfriend.com/archery-help/bow-sight-selection-guide.html>; 3 pages.

Barnett Outdoors, LLC; "Barnett Outdoors Lil Banshee Jr. Compound Youth Archery Set", Dated on or Before Aug. 12, 2013; 11 pages.

Hoyt Striker Bow, Hoyt USA catalogue, 1998 ("Hoyt I") (5 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated January 30, 2023.

Photographs of a "Conventional Mount Blk" identified therein as Hoyt Mounting Bracket (2 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

Kodiak Outdoor Bow, Hunting Forums | Realtree, May 28, 2007 ("Kodiak") (1 page), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

Compilation of: (a) Ripcord Fall-Away Arrow Rest Photographs, (b) Excerpts of Eastmans' Bowhunting Journal (cover page) stating "May-Jun. 2009," and (c) Excerpts of Eastmans' Bowhunting Journal (pp. 74-75) stating "New for 2008" (12 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

Shrewd Remedy Arrow Rest, www.shrewdarchery.com, Facebook, Jul. 13, 2017, including photograph of disassembled arrow rest at p. 16 ("Shrewd") (16 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

DS Advantage Arrow Rest—Photos and Internet Posts, certain sheets of which are dated Jan. 3, 2014 and Dec. 14, 2012 (8 pages), disclosed in *Lasermarx, Inc D/B/A Quality Archery Designs, Inc. and QTM, LLC* v. *Hamskea Archery Solutions, LLC*; Civil Action No. 1:22-cv-01956, served with Defendant Hamskea Archery Solutions, LLC's Initial Invalidity Contentions Dated Jan. 30, 2023.

*Lasermarx, Inc D/B/A Quality Archery Designs, Inc. and QTM, LLC* v. *Hamskea Archery Solutions, LLC*; Civil Action No. 1:22-cv-01956, Defendant Hamskea Archery Solutions, LLC's Initial Invalidity Contentions, Dated Jan. 30, 2023 (581 pages).

Hoyt Integra Direct Sight Manual Excerpt; "Hoyt Integra Direct Sight Mounting;" Dated on or Before Aug. 24, 2015; p. 11, 1 page.

Hoyt Integra Direct Sight Manual; Dated on or Before Aug. 24, 2015; 23 pages.

Ripcord X-Factor; Ripcord Arrow Rest; on or before Sep. 23, 2015; retrieved from the Internet: <http://ripcordarrowrest.com/ripcord-xfactor> , 4 pages.

Hamskea Full Capture VersaRest; Hamskea Archery Solutions; on or before Sep. 23, 2015; retrieved from the Internet <http://ripcordarrowrest.com/ripcord-xfactor>; 2 pages.

Elvish, Tac, Amazon; "Elvish Tac Picatinny Rail for Compound Bow-Stabilizer Mount—Bowhunting Bowfishing"; Oct. 17, 2019; retrieved from the Internet, <https://www.amazon.com/Elvish-Tac-Picatinny-Compound-Bow-Stabilizer/dp/B07Z8HJCCX/ref=pd_lpo_1?pd_rd_i=B07Z8HJCCX&psc=1>; 11 pages.

*Lasermarx, Inc D/B/A Quality Archery Designs, Inc. and QTM, LLC* v. *Hamskea Archery Solutions, LLC*; Case 1:22-cv-01956-KLM, Document 17, Motion for Dismissal and Summary Judgment of Invalidity; Filed Oct. 7, 2022, USDC Colorado (54 pages).

*Lasermarx, Inc. D/B/A Quality Archery Designs, Inc. and QTM, LLC* v. *Hamskea Archery Solutions, LLC*; Case 1:22-cv-01956-KLM, Document 28, Motion for Dismissal and Summary Judgment of Invalidity and Non-Infringement; Filed Nov. 11, 2022, USDC Colorado (38) pages).

Shrewd Remedy Arrow Rest; May 14, 2017; Case 1:22-cv-01956-NYW, Document 28-6; Filed Nov. 11, 2022, USDC Colorado (23 pages).

* cited by examiner

BOW ACCESSORY COUPLER AND METHOD

CROSS-REFERENCE TO RELATED APPLICATIONS

This application is a continuation of, and claims the benefit and priority of, U.S. patent application Ser. No. 16/926,182 filed on Jul. 10, 2020, which is a continuation of U.S. patent application Ser. No. 16/838,516 (now U.S. Pat. No. 11,098,974) filed on Apr. 2, 2020, which is a continuation of U.S. patent application Ser. No. 16/410,483 (now U.S. Pat. No. 10,690,437) filed on May 13, 2019, which is a continuation of U.S. patent application Ser. No. 16/012,364 (now U.S. Pat. No. 10,295,296) filed on Jun. 19, 2018, which is a continuation of U.S. patent application Ser. No. 15/809,349 (now U.S. Pat. No. 10,077,964) filed on Nov. 10, 2017, which is a continuation of U.S. patent application Ser. No. 15/247,456 (now U.S. Pat. No. 9,829,270) filed on Aug. 25, 2016, which is a non-provisional of, and claims the benefit and priority of, U.S. Provisional Patent Application No. 62/209,519 filed on Aug. 25, 2015. The entire contents of such applications are hereby incorporated by reference.

BACKGROUND

Different ways have been used to attach accessories, such as arrow rests and sights, to archery bows. In one way, a known arrow rest is screwed onto the bow riser using a screw inserted in a preexisting hole through the side of the bow. In another way, a known arrow rest is adhesively attached to the side of the bow. These known arrow rests have several disadvantages. With both arrow rests, it is difficult or cumbersome to adjust the position of the arrow rest after it's installed. Also, the adhesion is subject to failure after prolonged use and wear and tear of the bow, causing the known adhesive arrow rest to unexpectedly detach. Additionally, the known arrow rests are not designed to be conveniently uninstalled and reinstalled. Consequently, many users keep the known arrows rests installed while transporting their bows. As a result, transportation forces and contact with other objects can cause the orientation of the arrow rests on the bows to become unintentionally changed or misaligned.

In another approach, a known sight is mounted to a bow using a rigid mount. The riser of this bow has a groove on its side. The rigid mount has a lip that fits into the groove. Because of the looseness between the lip and groove, this known sight has a locking screw which extends through the rigid mount until it strikes the face of the bow riser. The user can vertically adjust this known sight by sliding the rigid mount along the groove and tightening the locking screw when the desired position is reached.

However, this known sight has several disadvantages. For example, the tightening of the locking screw forms a significant gap between the face of the riser and the rigid mount. Also, end of the locking screw generates a point force acting on the face of the riser. This gap and this point force can cause instability of the known sight on the riser. The point force, for example, can cause a wobbling effect based on the looseness between the lip and groove. Also, this gap can enable problematic vibrations to transmit from the bow to the known sight. These dynamic factors can impede the user's ability to fine tune his/her bow and to achieve, repeatable, optimal shooting performance. Likewise, these factors can impair the performance of the known sight, resulting in a detriment to shooting accuracy.

The foregoing background describes some, but not necessarily all, of the problems, disadvantages and shortcomings related to attaching bow accessories to bows.

SUMMARY

In an embodiment, a bow accessory coupler is described. The bow accessary coupler includes an accessory support configured to support an accessory and a mount connected to the accessory support. The mount is configured to be mounted to a riser of an archery bow and the riser includes a riser portion. The mount is configured to be transitioned from an adjustment condition in which the mount is moveable relative to the riser portion to a securing condition in which the mount is secured to the riser portion. The mount includes a plurality of riser engagers configured to be coupled to the riser portion. The plurality of riser engagers is configured to be flexed between a first arrangement and a second arrangement. The mount defines a flex space located between the riser engagers. In the first arrangement, the flex space has a first dimension and in the second arrangement, the flex space has a second dimension. The first arrangement is associated with the adjustment condition and the second arrangement is associated with the securing condition. A fastener is configured to be coupled to the mount so as to set the mount in the securing condition.

DETAILED DESCRIPTION

Figure 1:
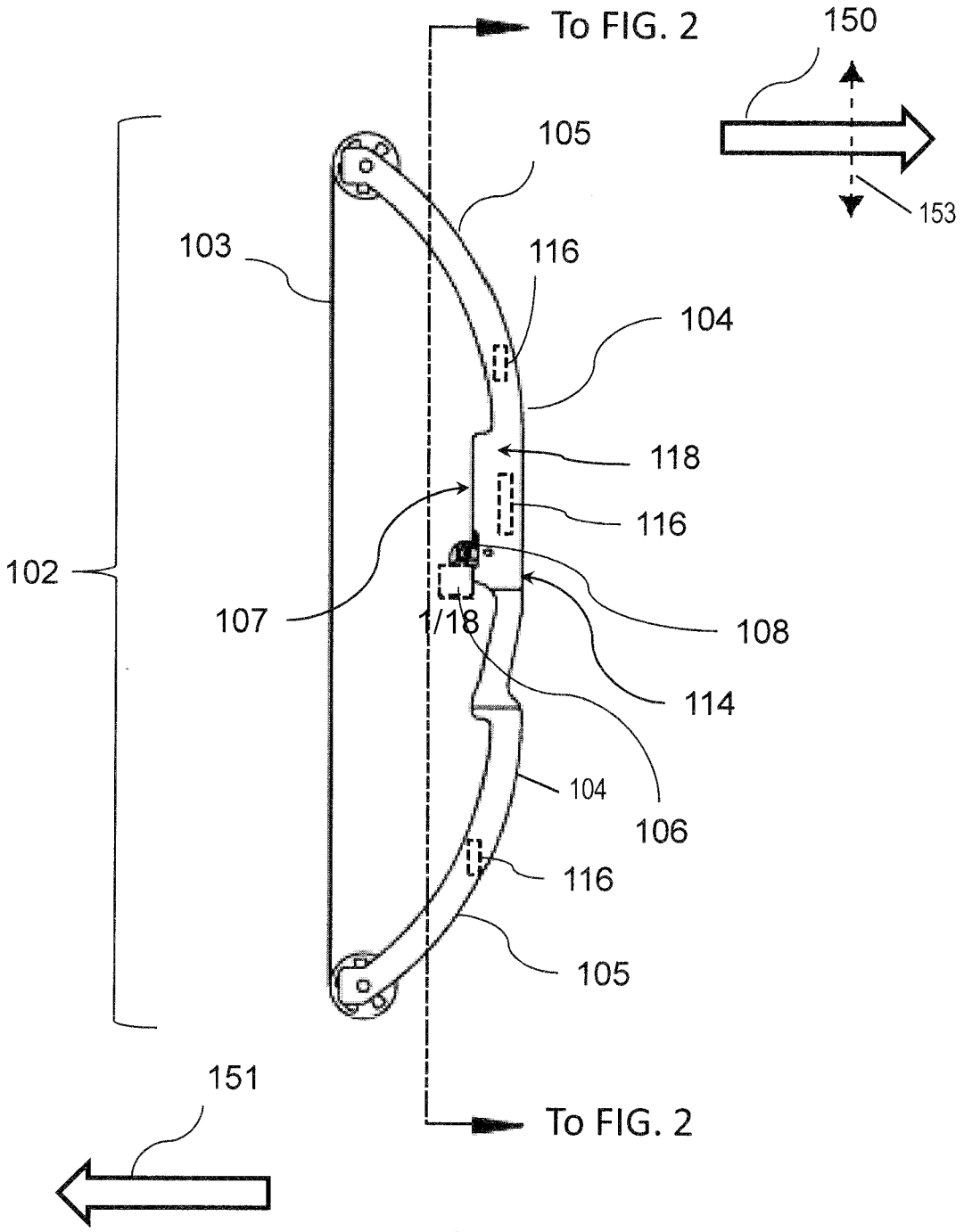
FIG. 1 is a side view of an archery bow having an embodiment of an accessory mount coupled to the bow riser.
Figure 2:
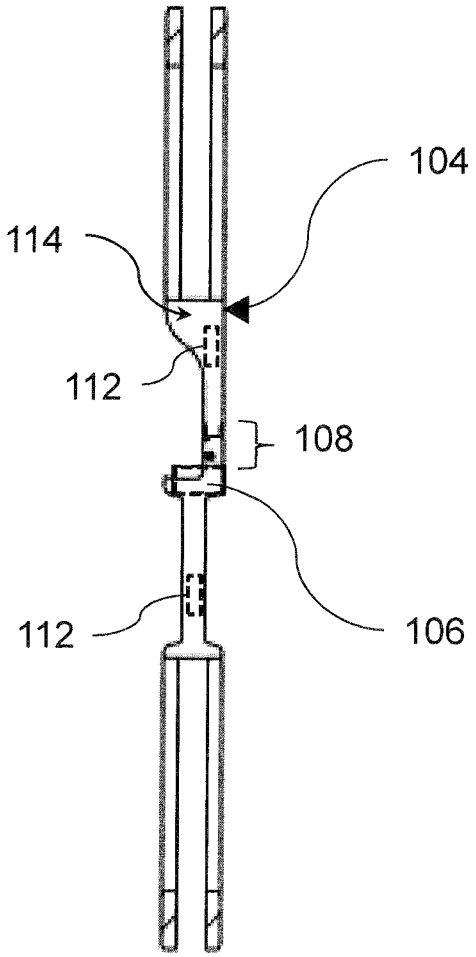
FIG. 2 is a front view of the archery bow of FIG. 1.
Figure 3:
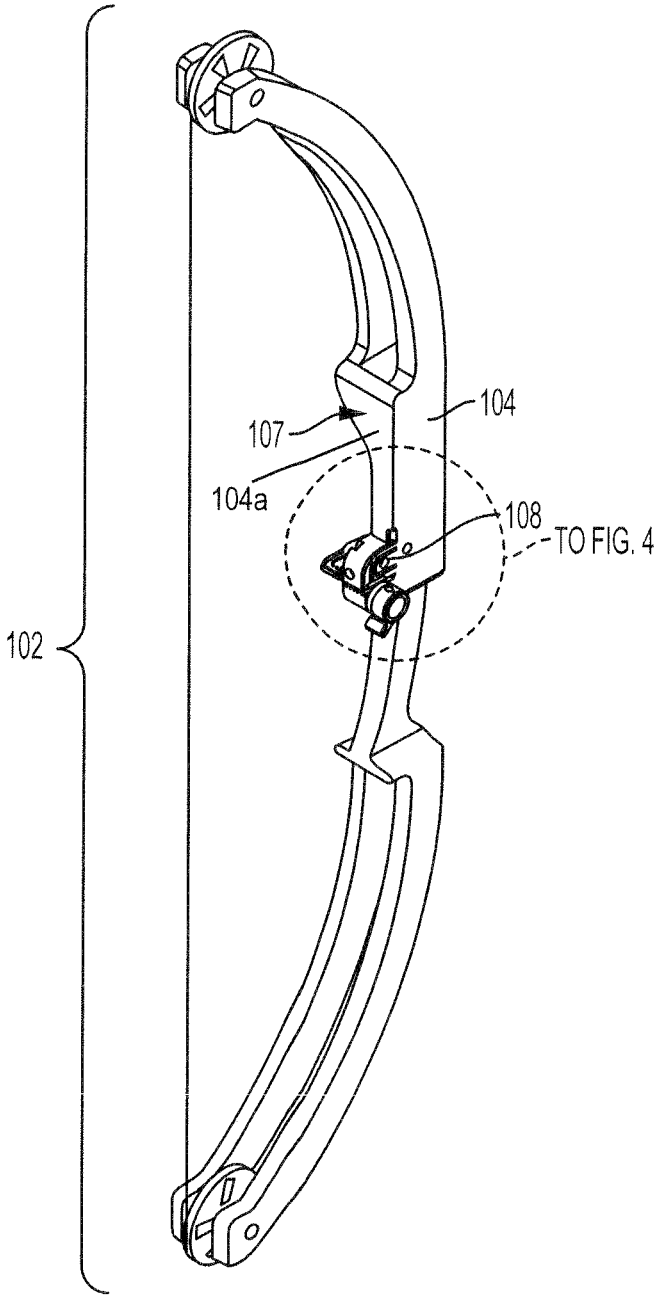
FIG. 3 is a rear isometric view of the archery bow of FIG. 1, showing another embodiment of an accessory mount coupled to the riser of the archery bow.

As illustrated in FIGS. 1-3, in one embodiment, an archery bow 102 includes a bowstring 103 coupled to limbs 105. The limbs 105 are coupled to a bow riser or riser 104. A bow accessory or accessory 106 can be attached or coupled to the bow 102 via an attachment or bow accessory coupler 108. For example, the accessory 106 can be coupled to the riser 104 via the bow accessory coupler 108. The accessory 106 can be any suitable type of accessory, including, but not limited to, an arrow rest or arrow holder configured to support an arrow, a sight device configured to aid in aiming, a light holder configured to support a light source, a flashlight, a power cable guide, a vibration dampener or other shooting aids or bow attachments.

Figure 4:
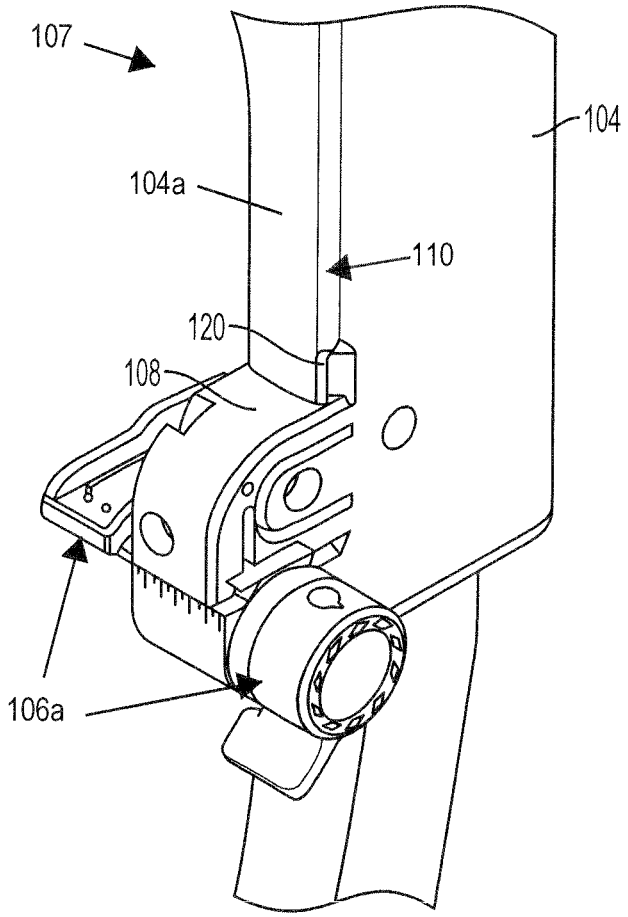
FIG. 4 is an enlarged view of the archery bow of FIG. 3.

As illustrated by FIGS. 1, 2 and 4, the bow 102 has one or more accessory mating or accessory coupling structures or surfaces, such as: (a) rear face coupling structure 104*a* and/or rear edge coupling structure 110 located on or near the rear side 107 of the bow 102; (b) front face coupling structure 112 and/or front edge coupling structure 104*b* located on or near the front side 114 of the bow 102; and (c) side coupling structures 116 located on either of the right or left sides 118 of the bow 102. In one embodiment, each of the coupling structures 19, 111, and 116 has, defines or incorporates a slot, groove, track, slide surface, slide director, notch, rail, or protrusion, such as protrusion 120 (FIG. 4), defining a vertical adjustment zone as described below. The bow accessory coupler 108 can be coupled to any of the coupling structures 104*a*, 104*b*, 19, 111, and 116.

Figure 5A:
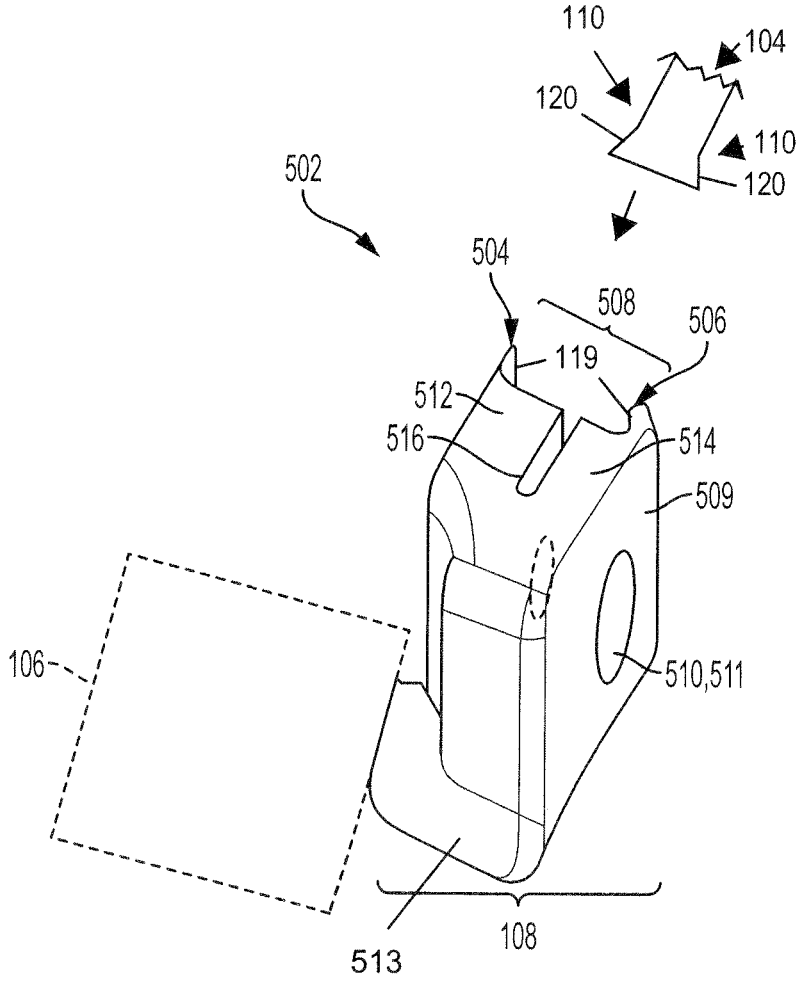
FIG. 5*a* is an isometric view of yet another embodiment of an accessory mount for an archery bow.

Referring to FIG. 1, when the bow 102 is positioned upright for operation, the front face 114 of the bow 102 faces in a forward or shooting direction 150 toward a target (not shown). The rear face 107 of the bow 102 is positioned facing the user, in a rearward direction 151 opposite the shooting direction 150. Also, the riser 104 of the bow 102 generally extends vertically and substantially parallel to a vertical axis 153. As illustrated by FIGS. 4 and 5*a*, the bow accessory coupler 108 can support or be coupled to an accessory such as arrow rest accessory 106*a* (FIG. 4) or accessory 106 (FIG. 5*a*). In an embodiment, the accessory 106 and the bow accessory coupler 108 can be a single, integral, monolithic object. In another example, the bow accessory coupler 108 can be removable from the accessory 106.

In an example, the accessory 106 is coupled to the bow accessory coupler 108 such that at least a portion of the accessory 106 extends in a plane that faces the target. In this embodiment, when the bow accessory coupler 108 is coupled to the riser 104 and the bow 102 is in the operational position, the accessory 106 is offset to the right or left of the bow accessory coupler 108. This offset position locates the accessory 106 into the user's field of vision, line of shooting action or aiming zone to facilitate shooting.

Figure 5B:
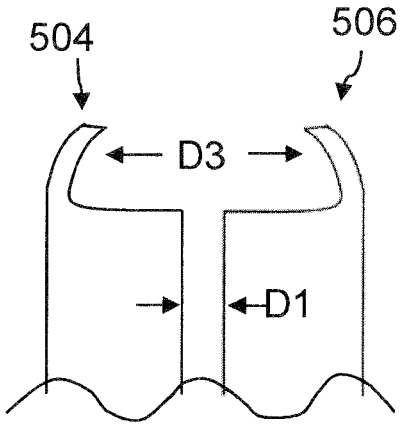
FIG. 5*b* is an illustration of the accessory mount of FIG. 5*a* in the adjustment condition.
Figure 5C:
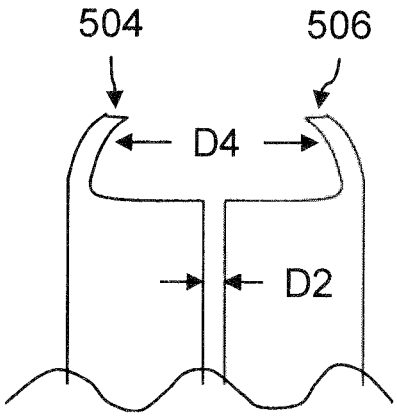
FIG. 5*c* is an illustration of the accessory mount of FIG. 5*a* in the securing condition.
Figure 13:
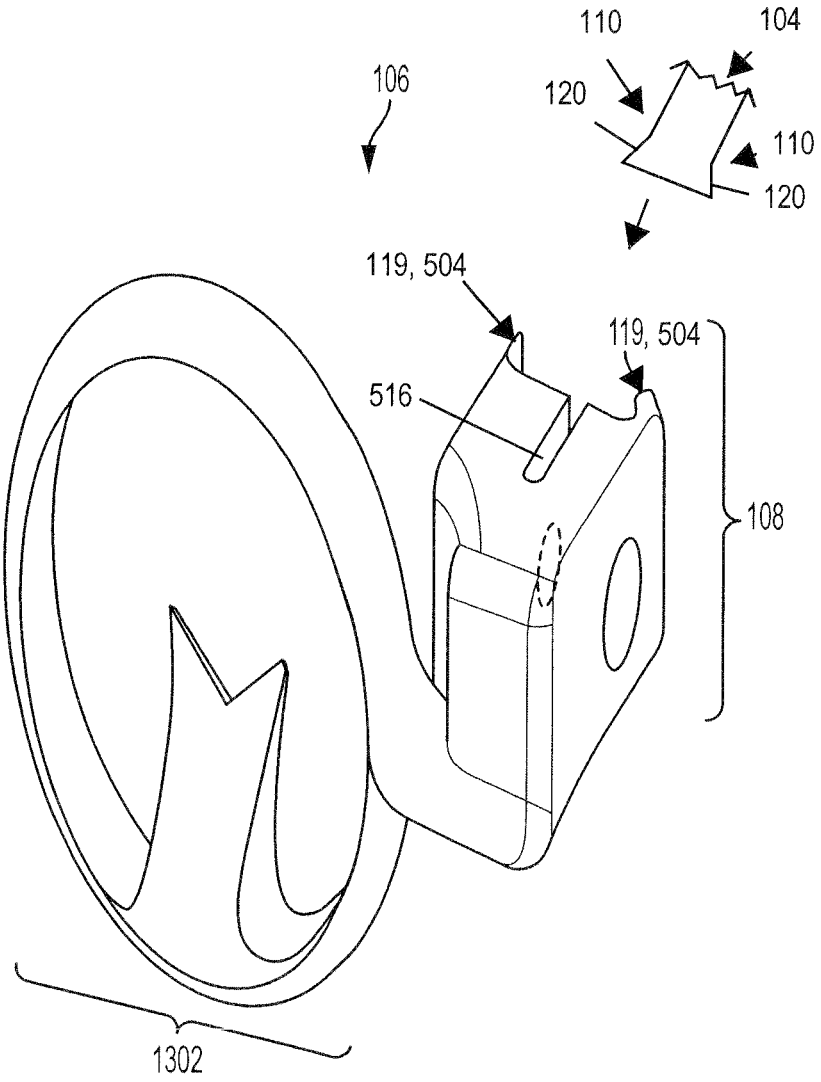
FIG. 13 is an isometric view of an embodiment of an accessory mount coupled to an arrow rest.

With particular reference to FIG. 5*a*, in an embodiment, the bow accessory coupler 108 includes a main body or mount 502 and an accessory support 513 coupled to the mount 502 and to which the accessory 106 is coupled. The mount 502 includes a plurality of flexible clamp arms or flexible clamp sections 511, 514 separated by a flex space 516. A first lateral member, rail engager, or riser engager 504 and a second lateral member, rail engager, or riser engager 506, directly opposite and parallel to the first rail engager 504, extend from the mount 502. The first riser engager 504 and the second rail engager 506 form a riser-receiving opening 508 for receiving the peak, notch, rail, or protrusion 120 (FIG. 4) of the coupling structures 104*a*, 110 of the bow 102. As illustrated by FIGS. 5*a* and 13, the first riser engager 504 and the second riser engager 506 can each include an inwardly angled lip 119 for securely engaging the dovetail-shaped rail 120 of the coupling structure 110. The riser engagers 504 and 506 are configured to be flexed, repositioned or otherwise moved relative to each other. For example, each of the riser engagers 504 and 506 is flexible so as to flex between a predisposed or adjustment position or condition and a locked or securing position or condition. In an embodiment, the flex space 516 has a first dimension D1 and a second dimension D2. In the adjustment condition illustrated in FIG. 5*b*, the engagers 504 and 506 are positioned apart by a first separation distance D3, and the flex space 516 has the first dimension D1. In the securing condition illustrated in FIG. 5*c*, the engagers 504 and 506 are inwardly flexed until they clamp upon and compress the dovetail-shaped rail 120. In this securing condition, the engagers 504 and 506 are positioned apart by a second separation distance D4, which is less than the first separation distance D3, and the flex space 516 has the second dimension D2, which is less than the first dimension D1. During the inward flexing process, the flex space 508 changes from the first dimension D1 to the second dimension D2, which is smaller than the first dimension D1. In this way, the riser engagers 504 and 506 form a clamp that clamps onto the rail or protrusion 120.

In an embodiment, when the mount 502 is secured to the riser 104, the flat surface of the mount face 503 of the mount 502 is flush against, and in contact with, the face coupling structure 104*a*. This face-to-face engagement enhances the stability of the mount 502 on the riser 104.

In an embodiment, the bow accessory coupler 108 further includes or defines an opening or a bore 510 that penetrates through the mount 502 perpendicular to the first and second riser engagers 504 and 506. The bore 510 can receive a fastener (not shown) for moving the first riser engager 504 closer to the second riser engager 506 to secure the bow accessory coupler 108 to the riser 104. The fastener can be any suitable type of fastener, including, but not limited to, a screw, bolt, spring or pin. In one embodiment, the fastener is a threaded bolt, and the bore wall 511 of one, but not both, of the clamp sections 511, 514 is threaded. In operation, referring to FIG. 5*a*, the user slides the body or mount 502 onto the dovetail-shaped rail 120. Then, the user inserts the bolt into the bore 510 until the head of the bolt abuts the face 509 of the clamp section 514. Then, the user screws the bolt which engages the threads of the bore wall 511. This brings the clamp sections 511, 514 together which squeeze the dovetail-shaped rail 120 to establish a fixed or locked position on the bow 102. Due to the vertical adjustment zone of the dovetail-shaped rail 120, the user can adjust the vertical position of the bow accessory coupler 108 on the bow 102 by slightly unscrewing the bolt, repositioning the coupler 108 upward or downward, such as by sliding, and then screwing the bolt. Furthermore, in this embodiment, neither such fastener nor any other fastener makes direct physical contact with the riser 104. Instead, such fastener physically contacts the mount 502 to control the movement of the riser engagers 504 and 506.

Figure 5D:
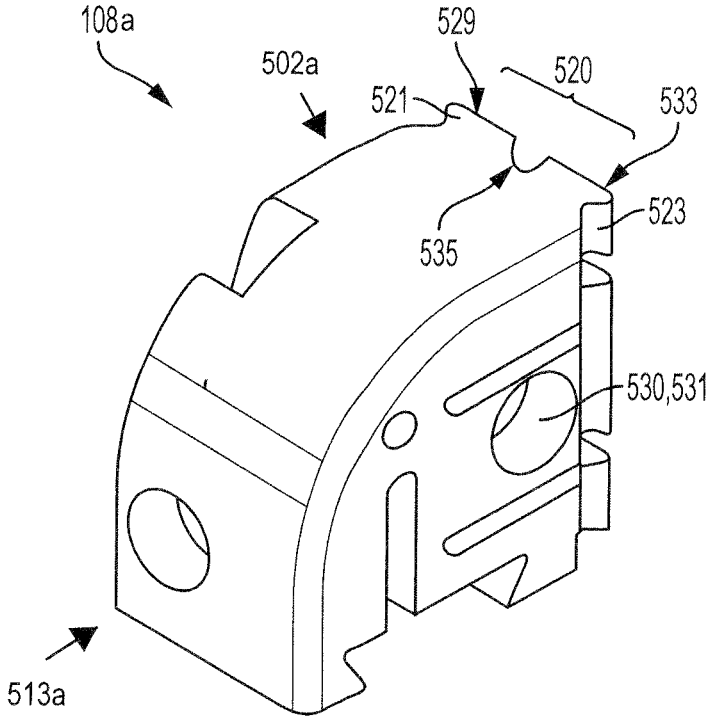
FIG. 5*d* is an isometric view of another embodiment of an accessory mount for an archery bow.
Figure 5E:
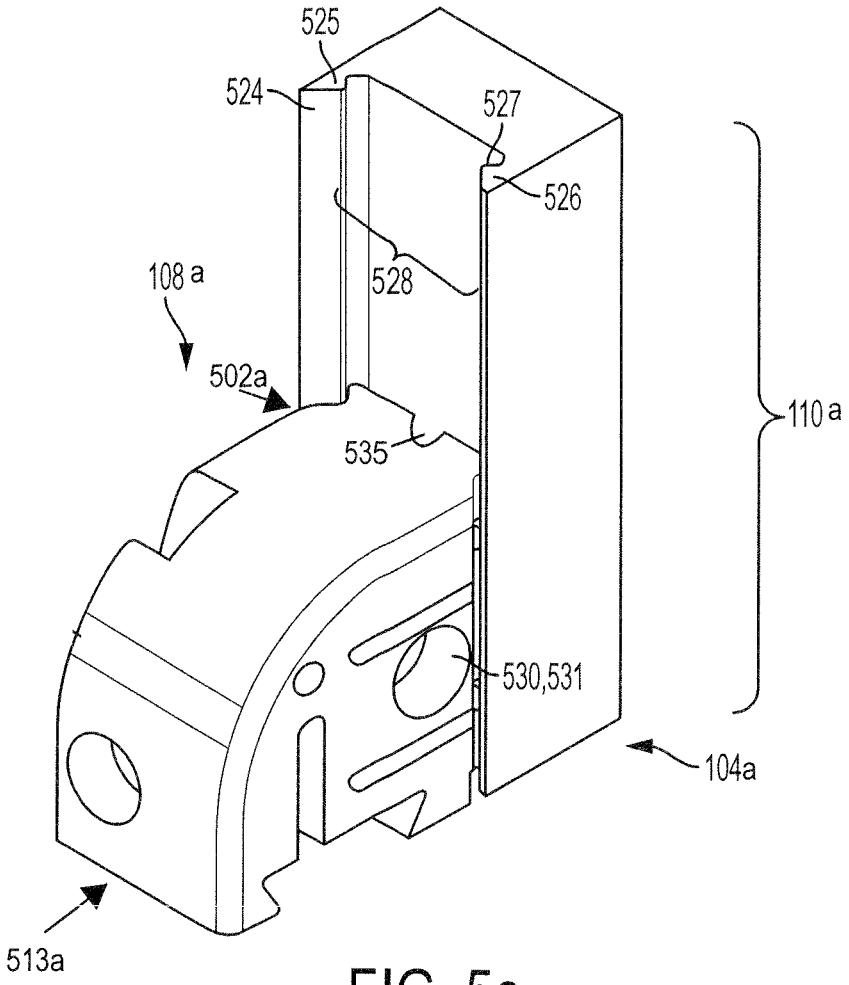
FIG. 5*e* is an isometric view of the accessory mount of FIG. 5*b* coupled to a portion of an archery bow riser.
Figure 5F:
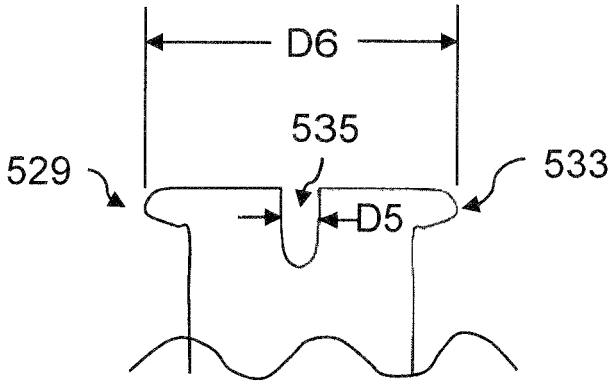
FIG. 5*f* is an illustration of the accessory mount of FIGS. 5*d*-5*e* in the adjustment condition.
Figure 5G:
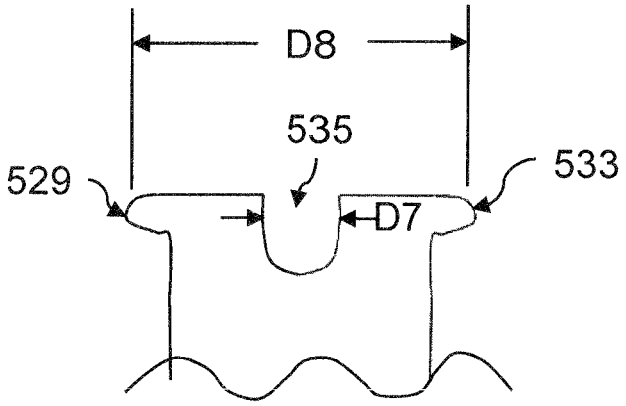
FIG. 5*g* is an illustration of the accessory mount of FIGS. 5*d*-5*e* in the securing condition.

In another embodiment, illustrated by FIGS. 5*d*-5*e*, the bow accessory coupler 108*a* includes a mount 502*a* and an accessory support 513*a* to which an accessory (not shown) is coupled. The mount 502*a* includes a dovetail-shaped protrusion, split peak, split notch, split insert or split rail 520. The split rail 520 has a rail section or riser engager 529 and a rail section or riser engager 533. The riser engager 529 has a first outwardly-angled lip 521, and riser engager 533 has a second outwardly-angled lip 523. The split rail 520 is configured to be inserted into the slot 528 of a bow riser 104*a* for securely engaging the coupling structure 110*a* of the bow riser 104*a*. The mount 502*a* defines a longitudinal flex space 535 between the rail sections 529 and 533. In this example, the mount 502*a* is configured to flex between a predisposed or adjustment position or condition and a locked or securing position or condition. In the adjustment condition illustrated in FIGS. 5*d* and 5*f*, the flex space 535 has a relatively small dimension D4, and the engagers 528, 530 are separated by a relatively small separation distance D6. In the securing condition, illustrated by FIGS. 5*e* and 5*g*, the rail lips 521, 523 of the bow accessory coupler 108 are outwardly flexed until they apply a force to the mount engagers or lips 524, 526 of the riser coupling structure 110. During the outward flexing, the flex space 535 increases to dimension D6, and the engagers 528, 530 are separated by separation distance D7, which is larger than separation distance D6. In this way, the split rail 520 is clamped or pressed onto the riser coupling structure 110*a*.

Referring to FIG. 5*e*, in an embodiment, the riser 104*a* has a first lateral member or mount engager 524 and a second lateral member or mount engager 526, directly opposite and parallel to the first mount engager 524. The mount engagers 524, 526 extend from the coupling structure 110*a* of the riser 104*a*. The first mount engager 524 and the second mount engager 526 form an opening 528 for receiving the split rail 520 of the bow accessory coupler 108*a*. As illustrated by FIG. 5*e*, the first mount engager 524 and the second mount engager 526 can each include an inwardly angled lip 524, 527 for securely engaging the outwardly angled lips 521, 523 of the rail 520 of the bow accessory coupler 108*a*.

In an embodiment, the bow accessory coupler 108*a* further includes or defines a fully or partially threaded opening or a bore 530 that penetrates through the mount 502 extending perpendicular to the split rail 520. The bore 530 can receive a fastener (not shown) for moving the first lip 521 of the split rail 520 outwardly and away from the second lip 523 of the split rail 520. In an example operation, the user inserts a threaded bolt or screw into the bore 530. The screw threadably engages the rail section 529 until making contact with an internal interference portion (not shown) of the rail section 531. As the user continues to rotate the screw, the screw drives the rail section 531, pushing it apart from the rail section 529. This exerts an outward clamping force on the riser engagers 524, 526 and secures the bow accessory coupler 108 to the coupling structure 110. This establishes a fixed, locked or securing condition on the bow 102. The fastener can be any suitable type of fastener, including, but not limited to, a screw, bolt, spring or pin. In one embodiment, the fastener is a set screw, and the bore wall 531 of the bore 530 is partially threaded. Furthermore, in this embodiment, neither such fastener nor any other fastener makes direct physical contact with the riser 104*a*. Instead, such fastener physically contacts the mount 502*a* to control the movement of the riser engagers 529 and 533.

To adjust the vertical position of the accessory coupler 108*a*, the user can partially unscrew the fastener from opening 530 to relieve the outward clamping or pressing force. Then, the user can adjust the vertical position of the bow accessory coupler 108*a* on the bow 102 by sliding the coupler 108*a* upward or downward relative to the riser 104*a*. After that, the user can retighten the fastener to increase the outward clamping or pressing force to re-establish the fixed or locked position.

In an embodiment not shown, the riser portions 524 and 526 of bow riser 104*a* are configured to be moved relative to each other in order to clamp the rail 520 of the bow accessory coupler 108*a*. For example, the riser portions 524, 526 can be configured to receive a fastener (not shown) for moving the first riser portion 524 closer to the second riser portion 526 to secure the rail 520 of the bow accessory coupler 108*a*.

Figure 6:
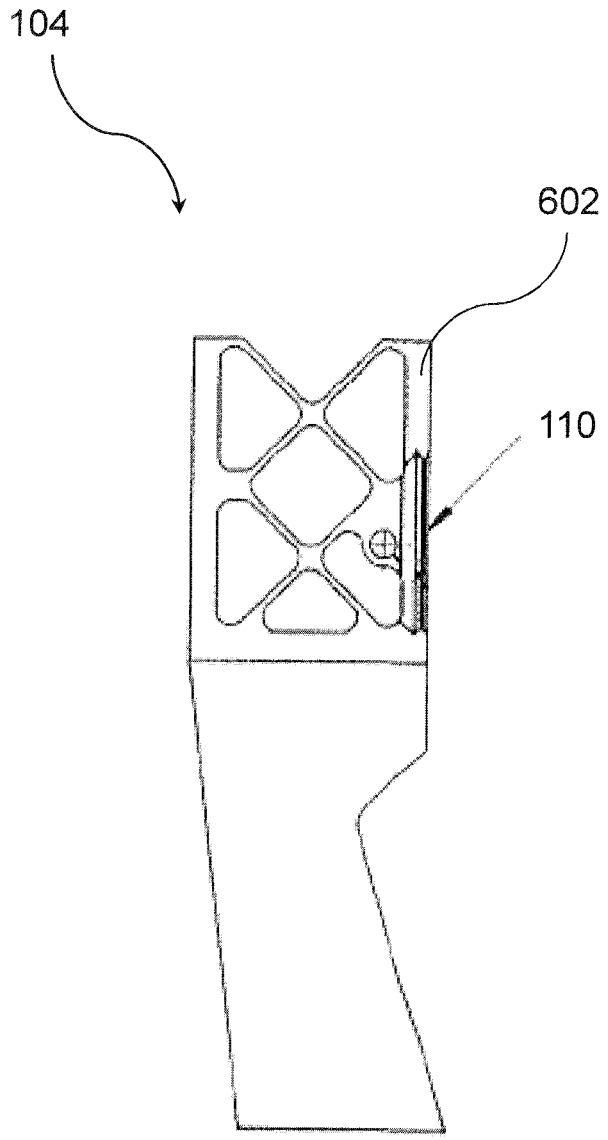
FIG. 6 is a side view of an embodiment of a portion of an archery bow riser having an accessory mount surface.
Figure 7:
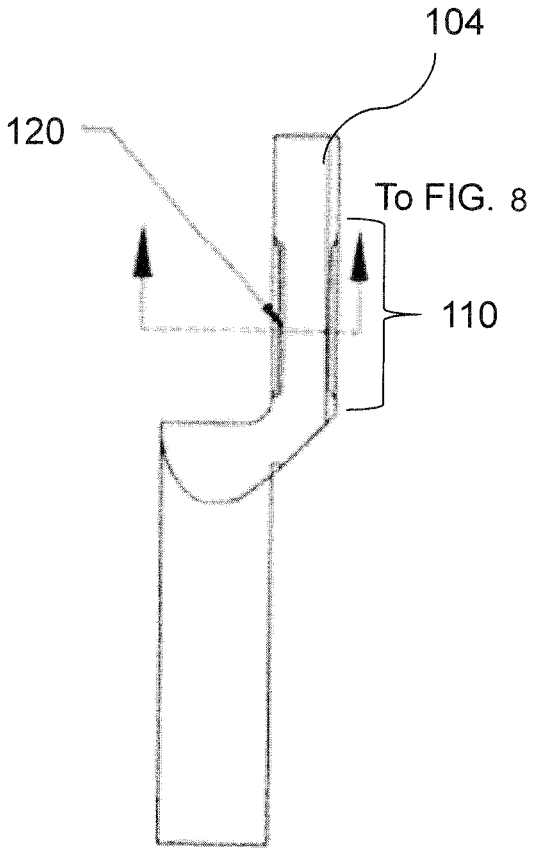
FIG. 7 is a front view of the archery bow riser of FIG. 6.
Figure 8:
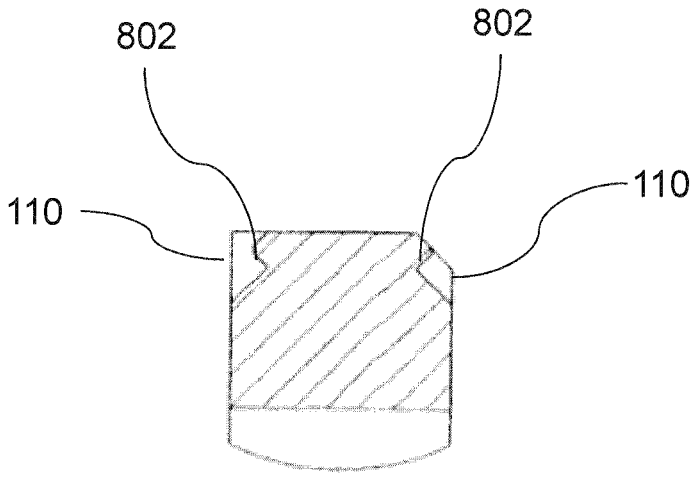
FIG. 8 is a cross-sectional view of the archery bow riser of FIG. 7, taken substantially along line 8-8.

In an embodiment, illustrated in FIGS. 6-8, the coupling structure 110 can be a point or elongated section or zone on the riser 104 for receiving the bow accessory coupler 108 (FIG. 5*a*). As illustrated in FIG. 6, the riser 104 can have a shape configured to mate with and receive the bow accessory coupler 108. For example, the track or dovetail-shaped rail 120 can be included as an element of the coupling structure 110. In another embodiment, the bow accessory coupler 108 is configured to mate with and attach to a conventional riser 104 that does not necessarily have a special shape for receiving the bow accessory coupler 108. In an embodiment, illustrated by FIG. 8, the coupling structure 110 has a dovetail shape including a notched or recessed portion for receiving the lips 119 of the first and second riser engagers 504 and 506 (FIG. 5*a*). For example, the coupling structure 110 can have a horizontal and/or vertical dovetail track or rail cut on the front or rear edge of the riser 104 for receiving the bow accessory coupler 108.

Figure 9:
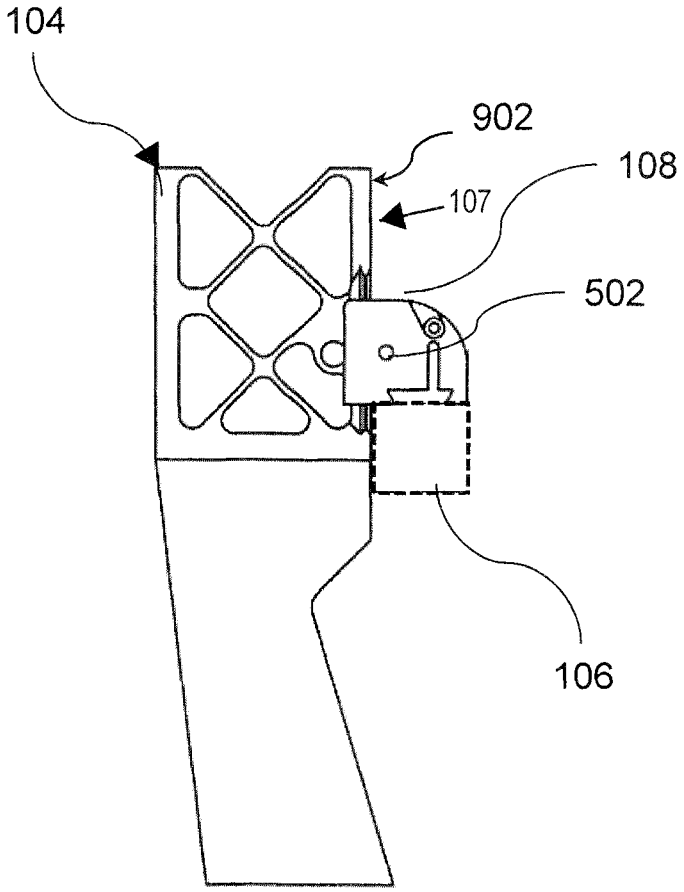
FIG. 9 is a side view of the archery bow riser of FIG. 6 having an embodiment of an accessory mount coupled thereto.
Figure 10:
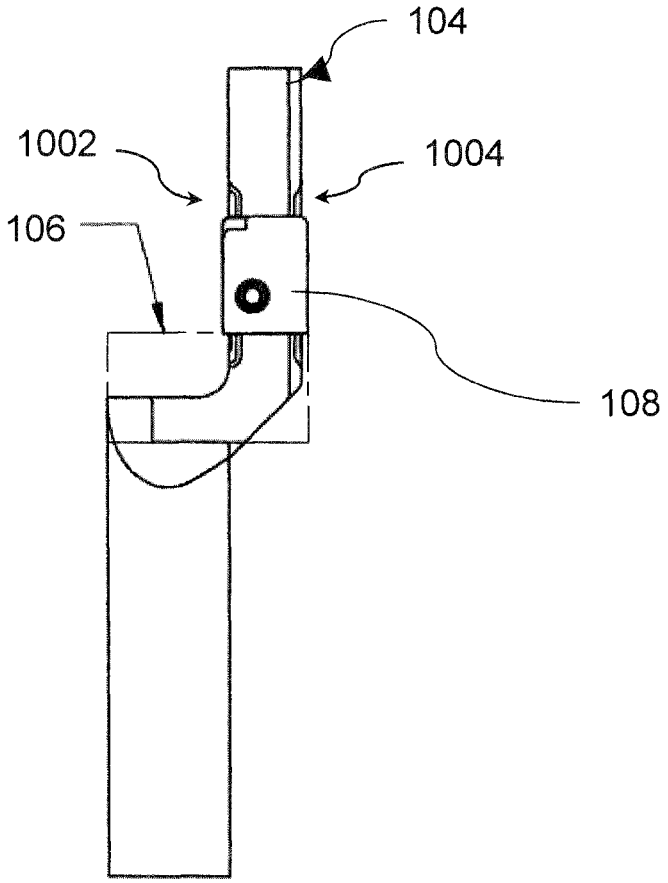
FIG. 10 is a front view of the archery bow riser of FIG. 9 having an embodiment of an accessory mount coupled thereto.
Figure 11:
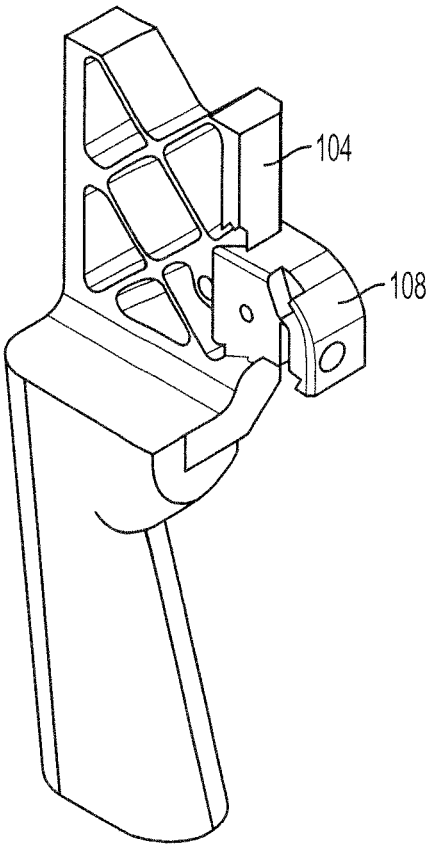
FIG. 11 is an isometric view of the archery bow riser of FIG. 9 having an embodiment of an accessory mount coupled thereto.
Figure 12:
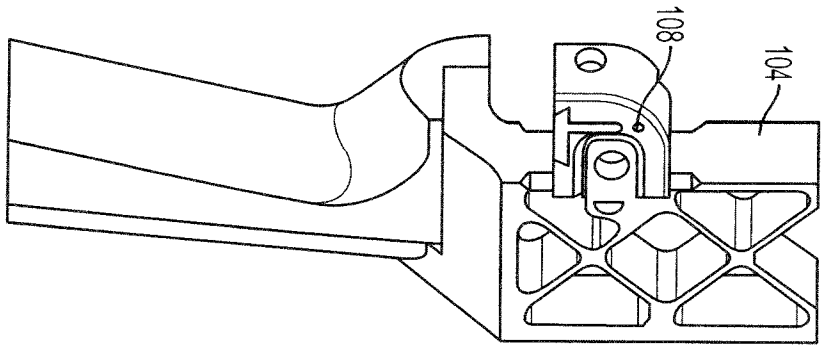
FIG. 12 is another isometric view of the archery bow riser of FIG. 11 having the embodiment of an accessory mount coupled thereto.

In the example illustrated by FIGS. 9-11, the bow accessory coupler 108 is configured to attach to the rear edge or rear side 107 of the riser 104 to couple the accessory 106 to the riser 104. The bow accessory coupler 108 secures the accessory 106 to the riser 104, for example, using a slip fit, press fit, snap fit, clamp fit or friction fit, to the riser 104. For example, the first and second riser engagers 504 and 506 can be placed on either side 1002, 1004 or either front or rear edge of the riser 104 and engage the riser 104, such as by tightening a fastener to clamp the first riser engager 504 and the second riser engager 506 together on the riser 104. In an example, the bow accessory coupler 108 is secured to a rear face or rear edge 902 of the riser 104. The slide-based cooperation between the coupler 108 and the dovetail-shaped rail 120 enables the user to slideably set the desired vertical position and then slideably adjust the vertical position for a new, desired setting, such as by slidably adjusting the vertical position. This configuration, in an embodiment, limits the movement to a vertical travel path relative to vertical axis 153 (FIG. 1), thereby eliminating undesirable degrees of freedom. The receipt of the elongated dovetail-shaped rail 120 by the coupler 108 stabilizes and secures the fixed position of the coupler 108 on the bow along the longitudinal and lateral axis of the riser 104. This can prevent the bow accessory coupler 108 from rotating, twisting or becoming misaligned along any axis of the riser 104 when subject to vibration, use, external forces, transportation or wear of the bow 102.

Depending upon the embodiment, any of the rails described herein can extend along the longitudinal axis of the bow 102, or such rail can extend along a lateral axis perpendicular to the bow's longitudinal axis. The rail extending along the longitudinal axis enables the user to adjust the vertical position of the accessory 106 relative to vertical axis 153. The rail extending along the lateral axis enables the user to adjust the lateral or left-to-right position of the accessory 106.

Figure 14:
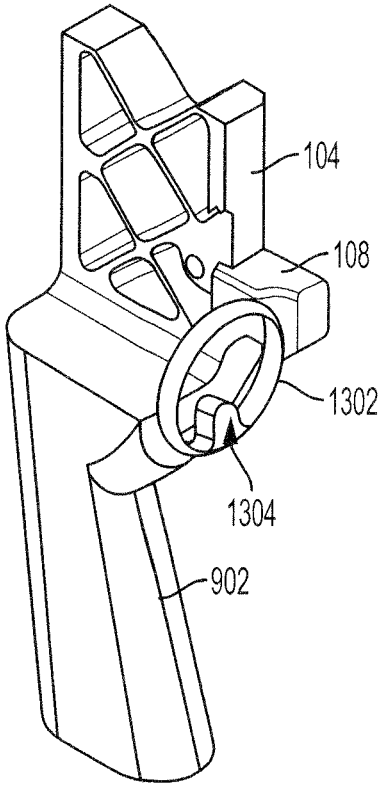
FIG. 14 is an isometric view of an archery bow riser having an embodiment of an arrow rest coupled thereto by an embodiment of an accessory mount.

In an embodiment, illustrated by FIGS. 13-14, the accessory 106 is an arrow rest 1302. The arrow rest 1302 is coupled, removably or permanently, to an bow accessory coupler 108. For example, the arrow rest 1302 is coupled to a rear edge 902 of a riser 104 via the bow accessory coupler 108, such as via a clamping force. The arrow holder 1304 is positioned at, or in line with, the center 1306 of the rear edge 902. When the archer places the arrow (not shown) in the arrow holder 1304, the arrow weight acts downward. Accordingly, the archer's upward grasp or grasp force is substantially in line with, or in line with, the downward arrow force or weight acting on the arrow holder 1304. By centering the arrow rest 1302, or any other type of accessory, at the rear edge 902 of the riser, the weight of the accessory 1302 does not urge the bow 102 to lean or tip to the right or to the left. In addition, with the arrow rest 1302 positioned on the rear edge 902 of the riser 104, the accessory is better placed for user access.

The bow accessory coupler 108 is configured to attach bow-related accessories directly to a bow riser or other portion of a bow, eliminating the need for a separate mounting bracket or arm. Because less pieces are utilized to attach accessories, the overall weight and complexity of the accessorized bow assembly is reduced. The bow accessory coupler 108 attaches accessories to the bow riser via a secure method as described above. In addition, accessories that require a specific orientation, e.g. horizontal, vertical, etc., can be fixed at that orientation with little or no risk of the angular orientation changing while slide adjustments to the accessory position are made. Thus, the bow accessory coupler 108 allows a degree of slide adjustment along an axis while the accessory's orientation in other directions remains unchanged.

The bow 102 can have different configurations of its accessory coupling structure. For example, the accessory coupling structure 100 extends along a longitudinal axis of the bow 102, enabling a vertical repositioning when the bow 102 is held upright. In another embodiment not shown, the bow's accessory coupling structure extends along a horizontal axis of the bow 102, enabling a horizontal repositioning when the bow 102 is held upright. Accordingly, depending upon the embodiment, the bow 102 and coupler 108 can cooperate to enable reliable repositioning of bow accessories vertically or horizontally, such as by slide-based repositioning.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A bow accessory coupler comprising:

a body comprising:

a first surface comprising a rear bow riser interface, wherein the first surface is configured to face in a forward direction toward a rear face of a bow riser of an archery bow when the bow accessory coupler is interfaced with the rear face;

a second surface configured to face in a rearward direction; and a portion comprising a dovetail shape, wherein the body defines at least one bore configured to receive a fastener, wherein the at least one bore extends in the forward direction when the bow accessory coupler is interfaced with the archery bow, wherein the portion is configured to adjustably mate with an element of an accessory, wherein the portion comprises a plurality of portion surfaces that are spaced apart from each other, wherein the element comprises a plurality of element surfaces that are spaced apart from each other, wherein the portion is configured to cooperate with the element of the accessory so that:

each of the portion surfaces is arranged to receive a securing force provided by one of the element surfaces;

the securing forces act along an axis that extends between the portion surfaces; and the securing forces at least partially secure the element of the accessory to the portion.

2. The bow accessory coupler of claim 1, wherein the rear bow riser interface comprises a portion of the first surface that is configured to be engaged with the rear face of the bow riser.

3. The bow accessory coupler of claim 1, wherein the dovetail shape of the portion defines a cavity configured to at least partially receive the element of the accessory.

4. The bow accessory coupler of claim 1, wherein each of the securing forces is one of:

(a) an initial element force provided by one of the element surfaces; or (b) a counteractive force provided by one of the elements surfaces in response to an initial portion force provided by one of the portion surfaces.

5. The bow accessory coupler of claim 1, wherein the portion is configured so that, when the portion is mated with the element of the accessory, the element of the accessory is secured to the portion as a result of the securing forces.

6. The bow accessory coupler of claim 1, wherein the portion is configured to cooperate with the element so that one of the portion or the element is compressed to set a position of the element relative to the portion.

7. The bow accessory coupler of claim 1, wherein the accessory comprises an arrow rest accessory.

8. The bow accessory coupler of claim 1, wherein the portion is configured to enable movement of the accessory relative to the body during an adjustment of the accessory.

9. The bow accessory coupler of claim 1, wherein the dovetail shape comprises a first width and a second width that is different than the first width.

10. The bow accessory coupler of claim 1, wherein a first one of the portion surfaces extends along a first plane and an opposing second one of the portion surfaces extends along a second plane, wherein the first and second planes intersect.

11. The bow accessory coupler of claim 1, wherein the body comprises a main body.

12. The bow accessory coupler of claim 1, wherein the body comprises a mount.

13. The bow accessory coupler of claim 1, wherein: (a) the body comprises a riser engager; and (b) the riser engager comprises the first surface.

14. The bow accessory coupler of claim 1, wherein: (a) the body comprises a split rail; (b) the split rail comprises a riser engager; and (c) the riser engager comprises the first surface.

15. The bow accessory coupler of claim 1, wherein the second surface comprises a rearward-facing surface.

16. The bow accessory coupler of claim 1, wherein: (a) the body comprises an accessory support; (b) the accessory support comprises a rearward-facing surface; and (c) the rearward-facing surface comprises the second surface.

17. The bow accessory coupler of claim 1, wherein the portion comprises at least part of a dovetail-shaped protrusion.

18. The bow accessory coupler of claim 1, wherein, when the first surface is oriented to face in the forward direction, the portion comprises a downward facing accessory interface.

19. The bow accessory coupler of claim 18, wherein: (a) the portion is associated with a female configuration; and (b) the downward facing accessory interface at least partially defines a cavity.

20. The bow accessory coupler of claim 1, wherein:
the portion comprises a mating interface that is spaced apart from the rear bow riser interface;
the rear bow riser interface comprises a rear bow riser mounting region of the first surface;
the mating interface comprises an archery accessory mounting region of the portion; and
when the body receives a mounting force, the mounting force at least partially causes the rear bow riser mounting region to be secured to the rear face of the bow riser.

21. The bow accessory coupler of claim 20, wherein the mating interface faces downward when the first surface is positioned to face in the forward direction.

22. The bow accessory coupler of claim 1, wherein:
the accessory comprises an arrow rest accessory;
the arrow rest accessory comprises an arrow holder;
the archery bow comprises a right side section that at least partially faces in a rightward direction when the archery bow is aimed in the forward direction;
the right side section extends along a right plane;
the archery bow comprises a left side section that at least partially faces in a leftward direction when the archery bow is aimed in the forward direction;
the left side section extends along a left plane; and
when the first surface is brought into contact with the rear face of the bow riser while the first surface faces in the forward direction: (a) the body is located entirely between the right and left planes; (b) the portion comprises a downward facing accessory interface, which comprises a female dovetail shape; and (c) the portion is structured to partially receive the arrow rest accessory, wherein the arrow rest accessory is movable relative to the portion along a lateral axis that intersects with the right and left planes, wherein each of the right and left planes passes through the arrow rest accessory.

23. The bow accessory coupler of claim 1, wherein each of the portion surfaces at least partially comprises an outwardly-angled lip.

24. The bow accessory coupler of claim 1, wherein, when the body is oriented in a vertical orientation:
the body extends along a vertical axis;
the first surface faces in the forward direction; and
the element is moveable along the vertical axis relative to the body while the element remains mated with the portion of the body.

25. The bow accessory coupler of claim 1, wherein:
the portion surfaces comprise a plurality of angled surfaces extending along intersecting axes; and
the dovetail shape is associated with the angled surfaces.

26. The bow accessory coupler of claim 1, wherein:
when the first surface is oriented to face in the forward direction, a forward axis extends in the forward direction through the first surface; and
the forward axis also extends through the rear face of the bow riser when the first surface is brought into contact with the rear face.

27. The bow accessory coupler of claim 26, wherein the at least one bore extends along the forward axis when the first surface is brought into contact with the rear face of the bow riser while the first surface faces in the forward direction.

28. The bow accessory coupler of claim 1, wherein, when the first surface is brought into contact with the rear face of the bow riser while the first surface faces in the forward direction, the first surface is located at least partially behind the rear face of the bow riser.

29. The bow accessory coupler of claim 1, wherein, when the first surface is brought into contact with the rear face of the bow riser while the first surface faces in the forward direction, the first surface is located fully behind the rear face of the bow riser.

30. The bow accessory coupler of claim 1, wherein, when the first surface is brought into contact with the rear face of the bow riser while the first surface faces in the forward direction, the rear bow riser interface is positioned entirely rearward of the rear face of the bow riser.

31. The bow accessory coupler of claim 1, wherein the rear bow riser interface is positioned entirely rearward of the rear face when the rear bow riser interface is secured to the rear face when the first surface faces in the forward direction.

32. The bow accessory coupler of claim 1, wherein:
the archery bow comprises a plurality of side sections, wherein each of the side sections at least partially faces in a lateral direction when the first surface is brought into contact with the rear face of the bow riser while the first surface faces in the forward direction; and
when the first surface is brought into contact with the rear face of the bow riser while the first surface faces in the forward direction, the side sections of the archery bow are free of contact with the body.

33. The bow accessory coupler of claim 1, wherein:
the archery bow comprises a plurality of side sections, wherein each of the side sections at least partially faces in a lateral direction when the first surface is brought into contact with the rear face of the bow riser while the first surface faces in the forward direction; and
when the first surface is brought into contact with the rear face of the bow riser while the first surface faces in the forward direction, the body covers no part of either of the side sections of the archery bow.

34. The bow accessory coupler of claim 33, wherein:

a first one of the side sections comprises a right riser portion; and a second one of the side sections comprises a left riser section.

35. The bow accessory coupler of claim 1, wherein:

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and when the first surface is brought into contact with the rear face of the bow riser while the first surface faces in the forward direction, the body is located entirely between the right and left planes.

36. The bow accessory coupler of claim 1, wherein:

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and when the first surface is brought into contact with the rear face of the bow riser while the first surface faces in the forward direction, the at least one bore is located entirely between the right and left planes.

37. The bow accessory coupler of claim 1, wherein:

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and when the fastener is positioned within the at least one bore when the first surface is brought into contact with the rear face of the bow riser while the first surface faces in the forward direction, the fastener is located entirely between the right and left planes.

38. The bow accessory coupler of claim 1, wherein the first surface is in contact with the rear face of the bow riser when the body is secured to the bow riser.

39. The bow accessory coupler of claim 1, wherein the second surface is located opposite of the first surface.

40. The bow accessory coupler of claim 1, wherein the portion comprises a part that contacts the element without contacting the rear face of the bow riser when the first surface is brought into contact with the rear face.

41. The bow accessory coupler of claim 1, wherein: (a) the rear bow riser interface comprises a first part of the first surface; (b) the first part comprises a first geometry; (c) the rear face of the bow riser comprises a second part; (d) the second part comprises a second geometry; and (e) the first geometry is identical to the second geometry.

42. An archery assembly comprising the bow accessory coupler of claim 1 and the accessory, wherein:

the accessory comprises an arrow rest accessory; and the arrow rest accessory comprises an arrow holder.

43. An archery assembly comprising the bow accessory coupler of claim 1 and the accessory, wherein:

the accessory comprises an arrow rest accessory; and the arrow rest accessory comprises an arrow holder that is structured to support an arrow.

44. A bow accessory coupler comprising:

a body comprising:

a first surface comprising an interface configured to face in a first direction and engage a rear face of a bow riser;

a second surface configured to face in a second direction; and a portion comprising a dovetail shape, wherein the body defines at least one opening configured to receive a fastener, wherein the portion is configured to be coupled to an element of an accessory, wherein:

the first direction comprises a forward direction directed toward a target;

the second direction comprises a rearward direction;

the portion is configured to mate with the element of the accessory;

the portion comprises a plurality of portion surfaces that are spaced apart from each other;

the element comprises a plurality of element surfaces that are spaced apart from each other; and the portion is configured to cooperate with the element of the accessory so that:

each of the portion surfaces is arranged to receive a force provided by one of the element surfaces;

the forces act along an axis that extends between the portion surfaces; and the forces at least partially secure the element of the accessory to the portion.

45. The bow accessory coupler of claim 44, wherein:

the forces are independent of any other force caused by the fastener; and each of the forces is one of: (a) an initial element force provided by one of the element surfaces; or (b) a counteractive force provided by one of the elements surfaces in response to an initial portion force provided by one of the portion surfaces; and the portion is configured to cooperate with the element of the accessory so that one of the portion or the element is compressed so as to set a position of the element relative to the portion.

46. The bow accessory coupler of claim 44, wherein the body comprises a main body.

47. The bow accessory coupler of claim 44, wherein the body comprises a mount.

48. The bow accessory coupler of claim 44, wherein: (a) the body comprises a riser engager; and (b) the riser engager comprises the first surface.

49. The bow accessory coupler of claim 44, wherein: (a) the body comprises a split rail; (b) the split rail comprises a riser engager; and (c) the riser engager comprises the first surface.

50. The bow accessory coupler of claim 44, wherein the second surface comprises a rearward-facing surface.

51. The bow accessory coupler of claim 44, wherein: (a) the body comprises an accessory support; (b) the accessory support comprises a rearward-facing surface; and (c) the rearward-facing surface comprises the second surface.

52. The bow accessory coupler of claim 44, wherein the portion comprises at least part of a dovetail-shaped protrusion.

53. The bow accessory coupler of claim 44, wherein, when the first surface is oriented to face in the forward direction, the portion comprises a downward facing accessory interface.

54. The bow accessory coupler of claim 53, wherein: (a) the portion is associated with a female configuration; and (b) the downward facing accessory interface at least partially defines a cavity.

55. The bow accessory coupler of claim 44, wherein:
the interface comprises a rear bow riser interface;
the portion comprises a mating interface that is spaced apart from the rear bow riser interface;
the rear bow riser interface comprises a rear bow riser mounting region of the first surface; and
the mating interface comprises an archery accessory mounting region of the portion.

56. The bow accessory coupler of claim 55, wherein the mating interface is oriented to face downward when the first surface is brought into contact with the rear face of the bow riser while the first surface faces in the forward direction.

57. The bow accessory coupler of claim 44, wherein:
the bow riser is part of an archery bow;
the accessory comprises an arrow rest accessory;
the arrow rest accessory comprises an arrow holder;
the archery bow comprises a right side section that at least partially faces in a rightward direction when the archery bow is aimed in the forward direction;
the right side section extends along a right plane;
the archery bow comprises a left side section that at least partially faces in a leftward direction when the archery bow is aimed in the forward direction;
the left side section extends along a left plane; and
when the first surface is brought into contact with the rear face of the bow riser while the first surface faces in the forward direction: (a) the body is located entirely between the right and left planes; (b) the portion comprises a downward facing accessory interface, which comprises a female dovetail shape; and (c) the portion is structured to partially receive the arrow rest accessory, wherein the arrow rest accessory is movable relative to the portion along a lateral axis that intersects with the right and left planes, wherein each of the right and left planes passes through the arrow rest accessory.

58. The bow accessory coupler of claim 44, wherein each of the portion surfaces at least partially comprises an outwardly-angled lip.

59. The bow accessory coupler of claim 44, wherein, when the body is oriented in a vertical orientation:
the body extends along a vertical axis;
the first surface faces in the forward direction; and
the element is moveable along the vertical axis relative to the body while the element remains mated with the portion of the body.

60. The bow accessory coupler of claim 44, wherein:
the portion surfaces comprise a plurality of angled surfaces extending along intersecting axes; and
the dovetail shape is associated with the angled surfaces.

61. The bow accessory coupler of claim 44, wherein:
when the first surface is oriented to face in the forward direction, a forward axis extends in the forward direction through the first surface; and
the forward axis also extends through the rear face of the bow riser when the first surface is brought into contact with the rear face.

62. The bow accessory coupler of claim 61, wherein the at least one opening extends along the forward axis when the first surface is brought into contact with the rear face of the bow riser while the first surface faces in the forward direction.

63. The bow accessory coupler of claim 44, wherein, when the first surface is brought into contact with the rear face of the bow riser while the first surface faces in the forward direction, the first surface is located at least partially behind the rear face of the bow riser.

64. The bow accessory coupler of claim 44, wherein, when the first surface is brought into contact with the rear face of the bow riser while the first surface faces in the forward direction, the first surface is located fully behind the rear face of the bow riser.

65. The bow accessory coupler of claim 44, wherein, when the first surface is brought into contact with the rear face of the bow riser while the first surface faces in the forward direction, the rear bow riser interface is positioned entirely rearward of the rear face of the bow riser.

66. The bow accessory coupler of claim 44, wherein the interface comprises a rear bow riser interface, wherein the rear bow riser interface is positioned entirely rearward of the rear face when the rear bow riser interface is secured to the rear face when the first surface faces in the forward direction.

67. The bow accessory coupler of claim 44, wherein:
the bow riser comprises a plurality of side sections, wherein each of the side sections at least partially faces in a lateral direction when the first surface is brought into contact with the rear face of the bow riser while the first surface faces in the forward direction; and
when the first surface is brought into contact with the rear face of the bow riser while the first surface faces in the forward direction, the side sections of the bow riser are free of contact with the body.

68. The bow accessory coupler of claim 44, wherein:
the bow riser comprises a plurality of side sections, wherein each of the side sections at least partially faces in a lateral direction when the first surface is brought into contact with the rear face of the bow riser while the first surface faces in the forward direction; and
when the first surface is brought into contact with the rear face of the bow riser while the first surface faces in the forward direction, the body covers no part of either of the side sections of the bow riser.

69. The bow accessory coupler of claim 68, wherein:
a first one of the side sections comprises a right riser portion; and
a second one of the side sections comprises a left riser section.

70. The bow accessory coupler of claim 44, wherein:
the bow riser is part of an archery bow;
the archery bow comprises a right side section that at least partially faces in a rightward direction when the archery bow is aimed in the forward direction;
the right side section extends along a right plane;
the archery bow comprises a left side section that at least partially faces in a leftward direction when the archery bow is aimed in the forward direction;
the left side section extends along a left plane; and
when the first surface is brought into contact with the rear face of the bow riser while the first surface faces in the forward direction, the body is located entirely between the right and left planes.

71. The bow accessory coupler of claim 44, wherein:
the bow riser is part of an archery bow;
the archery bow comprises a right side section that at least partially faces in a rightward direction when the archery bow is aimed in the forward direction;
the right side section extends along a right plane;
the archery bow comprises a left side section that at least partially faces in a leftward direction when the archery bow is aimed in the forward direction;
the left side section extends along a left plane; and
when the first surface is brought into contact with the rear face of the bow riser while the first surface faces in the forward direction, the at least one opening is located entirely between the right and left planes.

72. The bow accessory coupler of claim 44, wherein:
the bow riser is part of an archery bow;
the archery bow comprises a right side section that at least partially faces in a rightward direction when the archery bow is aimed in the forward direction;
the right side section extends along a right plane;
the archery bow comprises a left side section that at least partially faces in a leftward direction when the archery bow is aimed in the forward direction;
the left side section extends along a left plane; and
when the fastener is positioned within the at least one opening when the first surface is brought into contact with the rear face of the bow riser while the first surface faces in the forward direction, the fastener is located entirely between the right and left planes.

73. The bow accessory coupler of claim 44, wherein the first surface is in contact with the rear face of the bow riser when the body is secured to the bow riser.

74. The bow accessory coupler of claim 44, wherein the second surface is located opposite of the first surface.

75. The bow accessory coupler of claim 44, wherein the portion comprises a part that contacts the element without contacting the rear face of the bow riser when the first surface is brought into contact with the rear face.

76. The bow accessory coupler of claim 44, wherein: (a) the interface comprises a first part of the first surface; (b) the first part comprises a first geometry; (c) the rear face of the bow riser comprises a second part; (d) the second part comprises a second geometry; and (e) the first geometry is identical to the second geometry.

77. An archery assembly comprising the bow accessory coupler of claim 44 and the accessory, wherein:
the accessory comprises an arrow rest accessory; and
the arrow rest accessory comprises an arrow holder.

78. The bow accessory coupler of claim 44, wherein the at least one opening comprises a length that extends in the forward direction when the first surface is positioned to face in the forward direction.

79. The bow accessory coupler of claim 44, wherein:
the bow riser is part of an archery bow;
the archery bow comprises a right side that at least partially faces in a rightward direction when the archery bow is aimed in the forward direction;
the right side extends along a right plane;
the archery bow comprises a left side that at least partially faces in a leftward direction when the archery bow is aimed in the forward direction;
the left side extends along a left plane;
the at least one opening comprises a length that extends along a lateral axis when the first surface is positioned to face in the forward direction; and
the lateral axis passes through the right and left planes.

80. The bow accessory coupler of claim 44, wherein the body comprises an archery mount, the interface comprises a rear bow riser mounting region, and, when the archery mount receives a mounting force as a result of the fastener being at least partially inserted into the at least one opening, the mounting force at least partially causes the rear bow riser mounting region to be secured to the rear face of the bow riser.

81. The bow accessory coupler of claim 44, wherein the body comprises an archery mount, the interface comprises a rear bow riser mounting region, and, when the archery mount receives a mounting force as a result of the fastener being at least partially inserted into the at least one opening, the mounting force causes the rear bow riser mounting region to comprise an attached condition in which the rear bow riser mounting region is secured to the rear face of the bow riser, wherein the bow accessory coupler comprises a weight, wherein the mounting force is sufficient to counteract all of the weight to maintain the attached condition.

82. The bow accessory coupler of claim 44, wherein the body comprises an archery mount, the interface comprises a rear bow riser mounting region, and, when the archery mount receives an attaching force as a result of the fastener being at least partially inserted into the at least one opening, the attaching force causes the rear bow riser mounting region to comprise an attached condition in which the rear bow riser mounting region is secured to the rear face of the bow riser, wherein no part of the bow accessory coupler, other than the first surface, is secured to the bow riser.

83. An archery assembly comprising: (a) the bow accessory coupler of claim 44, wherein the body comprises an archery mount, and the interface comprises a rear bow riser mounting region; (b) the accessory; and (c) the fastener, wherein the fastener is configured to be inserted into the at least one opening, wherein, as a result of a rotation of the fastener within the at least one opening, the archery mount receives an attaching force, wherein the attaching force causes the rear bow riser mounting region to comprise an attached condition in which the rear bow riser mounting region is secured to the rear face of the bow riser.

84. A bow accessory coupler comprising:
a body comprising:
a first surface comprising an interface configured to face in a first direction and engage a rear face of a bow riser;
a second surface configured to face in a second direction; and
a portion comprising a dovetail shape,
wherein the body defines at least one opening configured to receive a fastener,
wherein the portion is configured to be coupled to an element of an arrow rest accessory,
wherein a first portion surface of the portion extends along a first plane and a second portion surface of the portion extends along a second plane, wherein the first and second planes intersect.

85. The bow accessory coupler of claim 84, wherein the at least one opening comprises a length that extends in the first direction when the first surface is positioned to face in the first direction.

86. The bow accessory coupler of claim 84, wherein:
the bow riser is part of an archery bow;
the bow riser comprises a right side that at least partially faces in a rightward direction when the archery bow is aimed in the first direction;
the right side extends along a right plane;

the bow riser comprises a left side that at least partially faces in a leftward direction when the bow riser is aimed in the first direction;

the left side extends along a left plane;

the at least one opening comprises a length that extends along a lateral axis when the first surface is positioned to face in the first direction; and the lateral axis passes through the right and left planes.

87. The bow accessory coupler of claim 84, wherein the body comprises an archery mount, the interface comprises a rear bow riser mounting region, and, when the archery mount receives a mounting force as a result of the fastener being at least partially moved into the at least one opening, the mounting force at least partially causes the rear bow riser mounting region to be secured to the rear face of the bow riser.

88. The bow accessory coupler of claim 87, wherein the rear bow riser mounting region comprises an attached condition as a result of the mounting force, wherein, in the attached condition, the rear bow riser mounting region is secured to the rear face of the bow riser, wherein the bow accessory coupler comprises a weight, wherein the mounting force is sufficient to counteract all of the weight to maintain the attached condition.

89. The bow accessory coupler of claim 87, wherein the rear bow riser mounting region comprises an attached condition as a result of the mounting force, wherein, in the attached condition, the first surface, and no other surface of the bow accessory coupler, is secured to the bow riser.

90. An archery assembly comprising: (a) the bow accessory coupler of claim 87; (b) the accessory; and (c) the fastener, wherein the fastener is configured to be at least partially positioned within the at least one opening, wherein, as a result of a rotation of the fastener within the at least one opening, the archery mount receives the mounting force, wherein the mounting force causes the rear bow riser mounting region to comprise an attached condition in which the rear bow riser mounting region is in contact with and secured to the rear face of the bow riser.

91. A bow accessory coupler comprising:

a body comprising:

a first surface comprising an interface configured to face in a first direction and engage a rear face of a bow riser;

a second surface configured to face in a second direction; and a portion comprising a dovetail shape, wherein the body defines at least one opening configured to receive a fastener, wherein the portion is configured to be coupled to an element of an accessory, wherein the accessory comprises an arrow rest accessory.

92. The bow accessory coupler of claim 91, wherein:

the body comprises an archery mount;

the interface comprises a rear bow riser interface;

the bow riser is a part of an archery bow that comprises right and left sides, wherein each of the right and left sides extends along a side plane;

the archery mount is located entirely between the side planes when the rear bow riser interface is engaged with the rear face of the bow riser; and the archery mount is associated with a mounted condition in which the first surface is in contact with and secured to the rear face of the bow riser.

93. The bow accessory coupler of claim 92, wherein the archery mount comprises a main body.

94. The bow accessory coupler of claim 92, wherein the archery mount comprises a mount.

95. The bow accessory coupler of claim 92, wherein: (a) the archery mount comprises a riser engager; and (b) the riser engager comprises the first surface.

96. The bow accessory coupler of claim 92, wherein: (a) the archery mount comprises a split rail; (b) the split rail comprises a riser engager; and (c) the riser engager comprises the first surface.

97. The bow accessory coupler of claim 92, wherein the second surface comprises a rearward-facing surface.

98. The bow accessory coupler of claim 92, wherein: (a) the archery mount comprises an accessory support; (b) the accessory support comprises a rearward-facing surface; and (c) the rearward-facing surface comprises the second surface.

99. The bow accessory coupler of claim 92, wherein the portion comprises at least part of a dovetail-shaped protrusion.

100. The bow accessory coupler of claim 92, wherein, when the first surface is oriented to face in the first direction, the portion comprises a downward facing accessory interface.

101. The bow accessory coupler of claim 100, wherein: (a) the portion is associated with a female configuration; and (b) the downward facing accessory interface at least partially defines a cavity.

102. The bow accessory coupler of claim 92, wherein:

the portion comprises a mating interface that is spaced apart from the rear bow riser interface;

the rear bow riser interface comprises a rear bow riser mounting region of the first surface; and the mating interface comprises an archery accessory mounting region of the portion.

103. The bow accessory coupler of claim 102, wherein the mating interface is oriented to face downward when the first surface is brought into contact with the rear face of the bow riser while the first surface faces in the first direction.

104. The bow accessory coupler of claim 92, wherein:

the bow riser is part of an archery bow;

the arrow rest accessory comprises an arrow holder;

the archery bow comprises a right side section that at least partially faces in a rightward direction when the archery bow is aimed in the first direction;

the right side section extends along a right plane;

the archery bow comprises a left side section that at least partially faces in a leftward direction when the archery bow is aimed in the first direction;

the left side section extends along a left plane; and when the first surface is brought into contact with the rear face of the bow riser while the first surface faces in the first direction: (a) the archery mount is located entirely between the right and left planes; (b) the portion comprises a downward facing accessory interface, which comprises a female dovetail shape; and (c) the portion is structured to partially receive the arrow rest accessory, wherein the arrow rest accessory is movable relative to the portion along a lateral axis that intersects with the right and left planes, wherein each of the right and left planes passes through the arrow rest accessory.

105. The bow accessory coupler of claim 92, wherein, when the archery mount is oriented in a vertical orientation:

the archery mount extends along a vertical axis;

the first surface faces in the first direction; and the element is moveable along the vertical axis relative to the archery mount while the element remains mated with the portion of the archery mount.

106. The bow accessory coupler of claim 92, wherein:

when the first surface is oriented to face in the first direction, a forward axis extends in the first direction through the first surface; and the forward axis also extends through the rear face of the bow riser when the first surface is brought into contact with the rear face.

107. The bow accessory coupler of claim 106, wherein the at least one opening extends along the forward axis when the first surface is brought into contact with the rear face of the bow riser while the first surface faces in the first direction.

108. The bow accessory coupler of claim 92, wherein, when the first surface is brought into contact with the rear face of the bow riser while the first surface faces in the first direction, the first surface is located at least partially behind the rear face of the bow riser.

109. The bow accessory coupler of claim 92, wherein, when the first surface is brought into contact with the rear face of the bow riser while the first surface faces in the first direction, the first surface is located fully behind the rear face of the bow riser.

110. The bow accessory coupler of claim 92, wherein, when the first surface is brought into contact with the rear face of the bow riser while the first surface faces in the first direction, the rear bow riser interface is positioned entirely rearward of the rear face of the bow riser.

111. The bow accessory coupler of claim 92, wherein the rear bow riser interface is positioned entirely rearward of the rear face when the rear bow riser interface is secured to the rear face when the first surface faces in the first direction.

112. The bow accessory coupler of claim 92, wherein:

each of the right and left sides at least partially faces in a lateral direction when the first surface is brought into contact with the rear face of the bow riser while the first surface faces in the first direction; and when the first surface is brought into contact with the rear face of the bow riser while the first surface faces in the first direction, the right and left sides of the archery bow are free of contact with the archery mount.

113. The bow accessory coupler of claim 92, wherein:

each of the right and left sides at least partially faces in a lateral direction when the first surface is brought into contact with the rear face of the bow riser while the first surface faces in the first direction; and when the first surface is brought into contact with the rear face of the bow riser while the first surface faces in the first direction, the archery mount covers no part of either of the right and left sides of the archery bow.

114. The bow accessory coupler of claim 92, wherein, when the first surface is brought into contact with the rear face of the bow riser while the first surface faces in the first direction, the at least one opening is located entirely between the right and left planes.

115. The bow accessory coupler of claim 92, wherein, when the fastener is positioned within the at least one opening when the first surface is brought into contact with the rear face of the bow riser while the first surface faces in the first direction, the fastener is located entirely between the right and left planes.

116. The bow accessory coupler of claim 92, wherein the first surface is in contact with the rear face of the bow riser when the archery mount is secured to the bow riser.

117. The bow accessory coupler of claim 92, wherein the second surface is located opposite of the first surface.

118. The bow accessory coupler of claim 92, wherein the portion comprises a part that contacts the element without contacting the rear face of the bow riser when the first surface is brought into contact with the rear face.

119. An archery assembly comprising the bow accessory coupler of claim 92, the fastener, and the accessory, wherein:

the accessory comprises an arrow rest accessory; and the arrow rest accessory comprises an arrow holder.

120. The bow accessory coupler of claim 92, wherein the at least one opening comprises a length that extends in the first direction when the first surface is positioned to face in the first direction.

121. The bow accessory coupler of claim 92, wherein:

the bow riser is part of an archery bow;

the archery bow comprises a right side that at least partially faces in a rightward direction when the archery bow is aimed in the first direction;

the right side extends along a right plane;

the archery bow comprises a left side that at least partially faces in a leftward direction when the archery bow is aimed in the first direction;

the left side extends along a left plane;

the at least one opening comprises a length that extends along a lateral axis when the first surface is positioned to face in the first direction; and the lateral axis passes through the right and left planes.

122. The bow accessory coupler of claim 92, wherein, when the archery mount receives a mounting force as a result of the fastener being at least partially inserted into the at least one opening, the mounting force at least partially causes the rear bow riser mounting region to be secured to the rear face of the bow riser.

123. The bow accessory coupler of claim 92, wherein, when the archery mount receives a mounting force as a result of the fastener being at least partially inserted into the at least one opening, the mounting force causes the rear bow riser mounting region to comprise an attached condition in which the rear bow riser mounting region is secured to the rear face of the bow riser, wherein the bow accessory coupler comprises a weight, wherein the mounting force is sufficient to counteract all of the weight to maintain the attached condition.

124. The bow accessory coupler of claim 92, wherein, when the archery mount receives an attaching force as a result of the fastener being at least partially inserted into the at least one opening, the attaching force causes the rear bow riser mounting region to comprise an attached condition in which the rear bow riser mounting region is secured to the rear face of the bow riser, wherein no part of the bow accessory coupler, other than the first surface, is secured to the bow riser.

125. An archery assembly comprising: (a) the bow accessory coupler of claim 92; (b) the accessory; and (c) the fastener, wherein the fastener is configured to be inserted into the at least one opening, wherein, as a result of a rotation of the fastener within the at least one opening, the archery mount receives an attaching force, wherein the attaching force causes the rear bow riser mounting region to comprise an attached condition in which the rear bow riser mounting region is secured to the rear face of the bow riser.

126. A method of manufacturing a bow accessory coupler, the method comprising:

configuring a body so that:

the body comprises:

a first surface comprising an interface configured to face in a forward direction and engage a rear surface of a bow riser;

a second surface configured to face in a rearward direction; and a portion comprising a dovetail shape, the body defines at least one opening configured to receive a fastener, the portion is configured to mate with an element of an arrow rest accessory.

127. The method of claim 126, wherein:

the element comprises a plurality of element surfaces that are spaced apart from each other;

the configuring of the body comprises configuring the portion to:

comprise a plurality of portion surfaces that are spaced apart from each other;

cooperate with the element of the arrow rest accessory so that:

each of the portion surfaces is arranged to receive a force provided by one of the element surfaces;

the forces act along an axis that extends between the portion surfaces; and the forces at least partially secure the element of the arrow rest accessory to the portion.

128. The method of claim 127, wherein:

the forces are independent of any other force caused by the fastener; and each of the forces is one of:

(a) an initial element force provided by one of the element surfaces; or (b) a counteractive force provided by one of the elements surfaces in response to an initial portion force provided by one of the portion surfaces.

129. The method of claim 126, wherein the configuring of the body comprises configuring the portion to cooperate with the element of arrow rest accessory so that one of the portion or the element is compressed so as to set a position of the element relative to the portion.

130. The method of claim 126, wherein the configuring of the body comprises configuring the portion to cooperate with the element of arrow rest accessory so that one of the portion or the element is subject to a compression force independent of any force caused by the fastener.

131. The method of claim 126, comprising configuring the body to comprise a main body.

132. The method of claim 126, comprising configuring the body to comprise a mount.

133. The method of claim 126, comprising:

configuring the body to comprise a riser engager; and configuring the riser engager to comprise the first surface so that the first surface is securable to the rear face of the bow riser.

134. The method of claim 126, comprising:

configuring the body to comprise a split rail;

configuring the split rail to comprise a riser engager; and configuring the riser engager to comprise the first surface.

135. The method of claim 126, comprising configuring the second surface to comprise a rearward-facing surface.

136. The method of claim 126, comprising:

configuring the body to comprise an accessory support;

configuring the accessory support to comprise a rearward-facing surface; and configuring the rearward-facing surface to comprise the second surface.

137. The method of claim 126, comprising configuring the portion to comprise at least part of a dovetail-shaped protrusion.

138. The method of claim 126, comprising configuring the portion to comprise an accessory interface that faces downward when the first surface is positioned to face in the forward direction.

139. The method of claim 138, comprising:

configuring the portion to be associated with a female configuration; and configuring the accessory interface to at least partially defines a cavity.

140. The method of claim 126, comprising:

configuring the interface to comprise a rear bow riser interface that is configured to be in contact with and secured to the rear surface of the bow riser; and configuring the portion to comprise a mating interface that is spaced apart from the rear bow riser interface; and configuring the mating interface to be in contact with and mated with the element of the arrow rest accessory.

141. The method of claim 140, comprising configuring the mating interface to face downward when the first surface is brought into contact with and secured to the rear surface of the bow riser while the first surface faces in the forward direction.

142. The method of claim 126, wherein:

the bow riser is part of an archery bow that comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction; and the left side section extends along a left plane, wherein the method comprises configuring the body so that, when the first surface is brought into contact with the rear surface of the bow riser while the first surface faces in the forward direction:

the body is located entirely between the right and left planes;

the portion comprises a downward facing accessory interface, which comprises a female dovetail shape; and the portion is structured to partially receive the arrow rest accessory, wherein the arrow rest accessory is movable relative to the portion along a lateral axis that intersects with the right and left planes, wherein each of the right and left planes passes through the arrow rest accessory.

143. The method of claim 126, comprising configuring each of the portion surfaces to at least partially comprise an outwardly-angled lip.

144. The method of claim 126, comprising configuring the body so that, when the body is oriented in a vertical orientation:

the body extends along a vertical axis;

the first surface faces in the forward direction; and the element is moveable along the vertical axis relative to the body while the element remains mated with the portion of the body.

145. The method of claim 126, comprising:

configuring the portion surfaces to comprise a plurality of angled surfaces extending along intersecting axes; and configuring the dovetail shape to be associated with the angled surfaces.

146. The method of claim 126, comprising configuring the body so that, when the first surface is positioned to face in the forward direction, a forward axis extends in the forward direction through the first surface, wherein the forward axis also extends through the rear surface of the bow riser when the first surface is brought into contact with the rear surface.

147. The method of claim 146, comprising configuring the body so that the at least one opening comprises a channel that extends along the forward axis when the first surface is brought into contact with the rear surface of the bow riser while the first surface faces in the forward direction.

148. The method of claim 126, comprising configuring the body so that, when the first surface is brought into contact with the rear surface of the bow riser while the first surface faces in the forward direction, the first surface is located at least partially behind the rear surface of the bow riser.

149. The method of claim 126, comprising configuring the body so that, when the first surface is brought into contact with the rear surface of the bow riser while the first surface faces in the forward direction, the first surface is located fully behind the rear surface of the bow riser.

150. The method of claim 126, comprising configuring the body so that, when the first surface is brought into contact with the rear surface of the bow riser while the first surface faces in the forward direction, the rear bow riser interface is positioned entirely rearward of the rear surface of the bow riser.

151. The method of claim 126, comprising configuring the body so that the interface comprises a rear bow riser interface, wherein the rear bow riser interface is positioned entirely rearward of the rear surface when the rear bow riser interface is secured to the rear surface when the first surface faces in the forward direction.

152. The method of claim 126, wherein:

the bow riser comprises a plurality of side sections, wherein each of the side sections at least partially faces in a lateral direction when the first surface is brought into contact with the rear surface of the bow riser while the first surface faces in the forward direction; and the method comprises configuring the body so that, when the first surface is brought into contact with the rear surface of the bow riser while the first surface faces in the forward direction, the side sections of the bow riser are free of contact with the body.

153. The method of claim 126, wherein:

the bow riser comprises a plurality of side sections, wherein each of the side sections at least partially faces in a lateral direction when the first surface is brought into contact with the rear surface of the bow riser while the first surface faces in the forward direction; and the method comprises configuring the body so that, when the first surface is brought into contact with the rear surface of the bow riser while the first surface faces in the forward direction, the body covers no part of either of the side sections of the bow riser.

154. The method of claim 126, wherein:

the bow riser is part of an archery bow;

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and the method comprises configuring the body so that, when the first surface is brought into contact with the rear surface of the bow riser while the first surface faces in the forward direction, the body is located entirely between the right and left planes.

155. The method of claim 126, wherein:

the bow riser is part of an archery bow;

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and the method comprises configuring the body so that, when the first surface is brought into contact with the rear surface of the bow riser while the first surface faces in the forward direction, the at least one opening is located entirely between the right and left planes.

156. The method of claim 126, wherein:

the bow riser is part of an archery bow;

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and the method comprises configuring the body so that the fastener is located entirely between the right and left planes when the fastener is positioned within the at least one opening while the first surface is brought into contact with the rear surface of the bow riser and the first surface faces in the forward direction.

157. The method of claim 126, comprising configuring the body so that the first surface is in contact with the rear surface of the bow riser when the body is secured to the bow riser.

158. The method of claim 126, comprising configuring the body so that the second surface is located opposite of the first surface.

159. The method of claim 126, comprising configuring the body so that the portion comprises a part that contacts the element without contacting the rear surface of the bow riser when the first surface is brought into contact with the rear surface.

160. The method of claim 126, comprising:

configuring the interface to comprise a rear bow riser interface configured to contact and be secured to the rear surface of the bow riser; and configuring the portion to comprise an archery interface that is spaced apart from the rear bow riser interface; and configuring the body so that, when the archery interface is mated with the element of the arrow rest accessory, one of the archery interface or the element is compressed.

161. The method of claim 126, wherein the arrow rest accessory comprises an arrow rest holder, wherein the method comprises configuring the body so that, when the body is vertically oriented and secured to the rear surface of the bow riser while the element is mated with the portion, the arrow rest holder is adjustably moveable relative to the body along a vertical axis.

162. The method of claim 126, comprising configuring the at least one opening to comprises a length that extends in the forward direction when the first surface is positioned to face in the forward direction.

163. The method of claim 126, wherein:

the bow riser is part of an archery bow;

the archery bow comprises a right side that at least partially faces in a rightward direction when the archery bow is aimed in the first direction;

the right side extends along a right plane;

the archery bow comprises a left side that at least partially faces in a leftward direction when the archery bow is aimed in the first direction; and the left side extends along a left plane, wherein the method comprises configuring the at least one opening to comprise a length that extends along a lateral axis when the first surface is positioned to face in the forward direction, wherein the lateral axis passes through the right and left planes.

164. The method of claim 126, comprising:

configuring the body to comprise an archery mount;

configuring the interface to comprise a rear bow riser mounting region; and configuring the archery mount so that, when the archery mount receives a mounting force as a result of the fastener being at least partially inserted into the at least one opening, the mounting force at least partially causes the rear bow riser mounting region to be secured to the rear face of the bow riser.

165. The method of claim 126, comprising:

configuring the body to comprise an archery mount;

configuring the interface to comprise a rear bow riser mounting region; and configuring the archery mount so that, when the archery mount receives a mounting force as a result of the fastener being at least partially inserted into the at least one opening, the mounting force causes the rear bow riser mounting region to comprise an attached condition in which the rear bow riser mounting region is secured to the rear face of the bow riser, wherein the bow accessory coupler comprises a weight, wherein the mounting force is sufficient to counteract all of the weight to maintain the attached condition.

166. The method of claim 126, comprising:

configuring the body to comprise an archery mount;

configuring the interface to comprise a rear bow riser mounting region; and configuring the archery mount so that, when the archery mount receives an attaching force as a result of the fastener being at least partially inserted into the at least one opening, the attaching force causes the rear bow riser mounting region to comprise an attached condition in which the rear bow riser mounting region is secured to the rear face of the bow riser, wherein no part of the bow accessory coupler, other than the first surface, is secured to the bow riser.

167. A method of manufacturing an archery assembly comprising:

the method of claim 126, comprising configuring the body to comprise an archery mount, and configuring the interface to comprise a rear bow riser mounting region;

coupling the arrow rest accessory to the body; and obtaining the fastener, wherein the fastener is configured to be inserted into the at least one opening, wherein, as a result of a rotation of the fastener within the at least one opening, the archery mount receives an attaching force, wherein the attaching force causes the rear bow riser mounting region to comprise an attached condition in which the rear bow riser mounting region is secured to the rear face of the bow riser.

168. A bow accessory coupler comprising:

an archery mount comprising:

(a) a first surface comprising a rear bow riser mounting region, wherein, when the first surface is positioned to face in a forward direction toward a rear face of a bow riser of an archery bow, the rear bow riser mounting region faces the rear face of the bow riser;

(b) a second surface that faces in a rearward direction, wherein the rearward direction is opposite of the forward direction; and (c) a portion comprising a dovetail shape, wherein the archery mount defines at least one bore, wherein the rear bow riser mounting region is securable to the rear face of the bow riser as a result of a fastener being at least partially inserted into the at least one bore, wherein the portion comprises an archery accessory mounting region, wherein the archery accessory mounting region comprises a mating relationship with a part of an arrow rest accessory, wherein, when the portion is at least partially mated with the part of the arrow rest accessory, one of the portion or the part is at least partially compressed, wherein the arrow rest accessory comprises an arrow holder.

169. The bow accessory coupler of claim 168, wherein: (a) the archery accessory mounting region is associated with a female configuration; and (b) the archery accessory mounting region at least partially defines a cavity.

170. The bow accessory coupler of claim 168, wherein the rear bow riser mounting region is spaced apart from the archery accessory mounting region.

171. The bow accessory coupler of claim 170, wherein the archery accessory mounting region faces downward when the first surface is positioned to face in the forward direction.

172. The bow accessory coupler of claim 170, wherein the at least one bore comprises a length that extends in the forward direction when the first surface is positioned to face in the forward direction.

173. The bow accessory coupler of claim 170, wherein:

the bow riser is part of an archery bow;

the archery bow comprises a right side that at least partially faces in a rightward direction when the archery bow is aimed in the forward direction;

the right side extends along a right plane;

the archery bow comprises a left side that at least partially faces in a leftward direction when the archery bow is aimed in the forward direction;

the left side extends along a left plane;

the at least one bore comprises a length that extends along a lateral axis when the first surface is positioned to face in the forward direction; and the lateral axis passes through the right and left planes.

174. The bow accessory coupler of claim 173, wherein, when the archery mount receives a mounting force as a result of the fastener being at least partially inserted into the at least one bore, the mounting force at least partially causes the rear bow riser mounting region to be secured to the rear face of the bow riser.

175. The bow accessory coupler of claim 168, wherein, when the archery mount receives a mounting force as a result of the fastener being at least partially inserted into the at least one bore, the mounting force causes the rear bow riser mounting region to comprise an attached condition in which the rear bow riser mounting region is secured to the rear face of the bow riser, wherein the bow accessory coupler comprises a weight, wherein the mounting force is sufficient to counteract all of the weight to maintain the attached condition.

176. The bow accessory coupler of claim 168, wherein, when the archery mount receives an attaching force as a result of the fastener being at least partially inserted into the at least one bore, the attaching force causes the rear bow riser mounting region to comprise an attached condition in which the rear bow riser mounting region is secured to the rear face of the bow riser, wherein no part of the bow accessory coupler, other than the first surface, is secured to the bow riser.

177. The bow accessory coupler of claim 168, wherein:

the bow riser is part of an archery bow;

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and when the first surface is brought into contact with the rear face of the bow riser while the first surface faces in the forward direction: (a) the archery mount is located entirely between the right and left planes; (b) the archery accessory mounting region comprises a female dovetail shape; and (c) the portion is structured to partially receive the arrow rest accessory, wherein the arrow rest accessory is movable relative to the portion along a lateral axis that intersects with the right and left planes, wherein each of the right and left planes passes through the arrow rest accessory.

178. The bow accessory coupler of claim 168, wherein:

when the first surface is oriented to face in the forward direction, a forward axis extends in the forward direction through the first surface; and the forward axis also extends through the rear face of the bow riser when the first surface is brought into contact with the rear face.

179. The bow accessory coupler of claim 178, wherein the at least one bore extends along the forward axis when the first surface is brought into contact with the rear face of the bow riser while the first surface faces in the forward direction.

180. The bow accessory coupler of claim 168, wherein, when the first surface is brought into contact with the rear face of the bow riser while the first surface faces in the forward direction, the first surface is located at least partially behind the rear face of the bow riser.

181. The bow accessory coupler of claim 168, wherein, when the first surface is brought into contact with the rear face of the bow riser while the first surface faces in the forward direction, the first surface is located fully behind the rear face of the bow riser.

182. The bow accessory coupler of claim 168, wherein, when the first surface is brought into contact with the rear face of the bow riser while the first surface faces in the forward direction, the rear bow riser mounting region is positioned entirely rearward of the rear face of the bow riser.

183. The bow accessory coupler of claim 168, wherein:

the archery bow comprises a plurality of side sections, wherein each of the side sections at least partially faces in a lateral direction when the first surface is brought into contact with the rear face of the bow riser while the first surface faces in the forward direction; and when the first surface is brought into contact with the rear face of the bow riser while the first surface faces in the forward direction, the side sections of the archery bow are free of contact with the archery mount.

184. The bow accessory coupler of claim 168, wherein:

the archery bow comprises a plurality of side sections, wherein each of the side sections at least partially faces in a lateral direction when the first surface is brought into contact with the rear face of the bow riser while the first surface faces in the forward direction; and when the first surface is brought into contact with the rear face of the bow riser while the first surface faces in the forward direction, the archery mount covers no part of either of the side sections of the archery bow.

185. The bow accessory coupler of claim 168, wherein:

the bow riser is part of an archery bow;

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and when the first surface is brought into contact with the rear face of the bow riser while the first surface faces in the forward direction, the archery mount is located entirely between the right and left planes.

186. The bow accessory coupler of claim 168, wherein:

the bow riser is part of an archery bow;

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and when the first surface is brought into contact with the rear face of the bow riser while the first surface faces in the forward direction, the at least one bore is located entirely between the right and left planes.

187. The bow accessory coupler of claim 168, wherein:

the bow riser is part of an archery bow;

the archery bow comprises a right side section that at least partially faces in a rightward direction when the archery bow is aimed in the forward direction;

the right side section extends along a right plane;

the archery bow comprises a left side section that at least partially faces in a leftward direction when the archery bow is aimed in the forward direction;

the left side section extends along a left plane; and when the fastener is positioned within the at least one bore when the first surface is brought into contact with the rear face of the bow riser and while the first surface faces in the forward direction, the fastener is located entirely between the right and left planes.

188. The bow accessory coupler of claim 168, wherein the first surface is in contact with the rear face of the bow riser when the archery mount is secured to the bow riser.

189. An archery assembly comprising: (a) the bow accessory coupler of claim 168; (b) the arrow rest accessory; and (c) the fastener, wherein the fastener is configured to be inserted into the at least one bore, wherein, as a result of a rotation of the fastener within the at least one bore, the archery mount receives an attaching force, wherein the attaching force causes the rear bow riser mounting region to comprise an attached condition in which the rear bow riser mounting region is secured to the rear face of the bow riser.

190. The archery assembly of claim 189, wherein the bow accessory coupler is configured to cooperate with the arrow rest accessory to enable the arrow holder to be adjustably repositioned relative to the bow accessory coupler.

* * * * *